US005125636A

United States Patent [19]

Higashio et al.

[11] Patent Number: 5,125,636

[45] Date of Patent: Jun. 30, 1992

[54] COPYING MACHINE CAPABLE OF COPYING TWO ORIGINALS ON ONE SHEET OF PAPER

[75] Inventors: Kimihiko Higashio; Masazumi Ito; Kadotaro Nishimori, all of Osaka, Japan

[73] Assignee: Minolta Camera Kabushiki Kaisha, Osaka, Japan

[21] Appl. No.: 715,851

[22] Filed: Jun. 17, 1991

Related U.S. Application Data

[63] Continuation of Ser. No. 470,686, Jan. 26, 1990, abandoned.

[30] Foreign Application Priority Data

Jan. 30, 1989 [JP] Japan ..... 1-20248

[51] Int. Cl.[5] ..... B65H 5/00

[52] U.S. Cl. ..... 271/9; 271/10; 355/311; 355/313

[58] Field of Search ..... 355/309, 311, 313; 271/3, 3.1, 4, 6, 7, 9, 10

[56] References Cited

U.S. PATENT DOCUMENTS

| | | | |
|---|---|---|---|
| 4,052,054 | 10/1977 | Cardwell et al. . | |
| 4,278,344 | 7/1981 | Sahay | 355/319 |
| 4,727,401 | 2/1988 | Partilla et al. . | |
| 4,731,637 | 3/1988 | Acquaviva et al. . | |
| 4,763,163 | 8/1988 | Hamano et al. . | |
| 4,771,319 | 9/1988 | Hamakawa . | |
| 4,804,997 | 2/1989 | Mizude et al. | 271/9 |
| 4,814,822 | 3/1989 | Acquaviva et al. | 355/319 |
| 4,920,377 | 4/1990 | Ito et al. | 355/55 |

FOREIGN PATENT DOCUMENTS

| | | | |
|---|---|---|---|
| 60-2942 | 1/1985 | Japan . | |
| 48502 | 2/1985 | Japan | 355/309 |
| 60-93463 | 5/1985 | Japan . | |
| 60-84945 | 6/1985 | Japan . | |
| 48608 | 8/1986 | Japan | 271/9 |
| 62-47264 | 2/1987 | Japan . | |
| 48805 | 5/1988 | Japan | 271/3 |
| 48811 | 11/1988 | Japan | 355/313 |
| 48904 | 4/1989 | Japan | 271/3 |

*Primary Examiner*—H. Grant Skaggs
*Assistant Examiner*—Carol Lynn Druzbick
*Attorney, Agent, or Firm*—Burns, Doane, Swecker & Mathis

[57] ABSTRACT

A copying apparatus of the present invention includes an original tray on which a plurality of originals can be placed; a conveying mode selecting apparatus for selecting a first mode and the second mode; a conveying apparatus for taking out one original at a time out of the plurality of originals placed on the original tray in the first mode for setting the same to an exposure position and for taking two originals continuously out of the plurality of originals placed on the original tray in the second mode for setting the same to the exposure position; an automatic paper feeding apparatus for automatically feeding sheets of copy paper of a prescribed the size one by one; a manual paper feeding apparatus for manually feeding sheets of copy paper of an arbitrary size; a paper feeding selecting apparatus for selecting either the automatic paper feeding apparatus or the manual paper feeding apparatus; and a controlling apparatus for inhibiting simultaneous selection of the second mode and the manual paper feeding apparatus.

36 Claims, 22 Drawing Sheets

COPYING MACHINE CAPABLE OF COPYING TWO ORIGINALS ON ONE SHEET OF PAPER

This application is a continuation of application Ser. No. 07/470,686, filed Jan. 26, 1990, now abandoned.

BACKGROUND OF THE INVENTION

1. Field of the Invention

The present invention relates to a copying machine and, more specifically, to a copying machine capable of copying in a manual feeding mode in which sheets of copy paper are manually fed, and in a so-called 2 in 1 mode in which images of two originals continuously fed are copied on a single sheet of copy paper.

2. Description of the Related Art

A copying machine in which the 2 in 1 mode can be set having an automatic document feeder (hereinafter referred to as an ADF) has been proposed.

In the 2 in 1 mode, two originals are continuously fed by using the ADF and they are arranged next to each other on a platen, with the images of the originals are read and copied on a former half and the latter half of a single sheet of copy paper.

Now, when a sheet of copy paper is divided into two by a line orthogonal to the paper feeding direction of the sheet of copy paper, an area on which the images are first formed will be referred as to the former half while the area in which the images are formed thereafter is referred as the latter half.

Meanwhile, a copying machine has been provided which has manual paper feeding means and capable of manually feeding sheets of copy paper.

The manual paper feeding means comprises a dedicated paper feeding inlet (manual paper feeding inlet) and a manual feed tray which can be arranged to guide the sheets of paper to the paper feeding inlet.

A manual feeding mode to carry out the copying operation by manual paper feeding is set when the above mentioned manual feeding tray is set in an available state (namely, a state in which the sheet of copy paper can be guided to the manual paper feed inlet), for instance.

The maximum width of the sheet of copy paper which can be manually fed is equal to the maximum width of possible image formation by the copying machine, in general. The maximum length of the sheet is equal to the maximum length of the possible image formation of the copying machine. In other words, if the size of the sheet of copy paper is in the above range, manual paper feeding is possible.

In this specification, the direction of setting the originals are defined as a breadthwise direction (in which the direction of feeding the original corresponds to the short side, as shown in FIG. 4A) and a lengthwise direction (in which the direction of feeding the original corresponds to the long side, as shown in FIG. 4B), and the directions of setting the sheet of copy paper are also defined in the same manner.

With the directions of setting the originals and the sheets of copy paper defined as described above, the 2 in 1 mode can be defined as a mode in which images of two originals continuously fed in the breadthwise direction are copied in composition in the former and the latter half of a sheet of copy paper fed in the lengthwise direction.

Therefore, in the 2 in 1 mode, the relation between the original size and the size of the copy of paper, and the relation between the set direction of the original and the set direction of the copy paper must be determined, and the sizes, the directions of setting and the copying magnification rate, if necessary, must be appropriately set accordingly.

The above described setting process is carried out by a CPU of the copying machine on the promise that the original and the sheet of copy paper are both of regular sizes. The size of the original and the size of the sheet of paper must be detected before the start of paper feeding operation.

However, the size of the sheet of copy paper which is manually fed cannot be detected before the start of paper feeding, as the sheet of copy paper is out of the copying machine, as described above. In addition, a sheet of copy paper having an irregular size may be fed.

Therefore, when the copying operation is carried out in the 2 in 1 mode by manual paper feeding, miscopies such as missing of images may be generated.

SUMMARY OF THE INVENTION

One object of the present invention is to improve reliability in a copying machine having a function of copying images of two originals on a single sheet of copy paper, and being capable of automatic paper feeding and manual paper feeding.

Another object of the present invention is to prevent missing of images in a copying machine having a function of copying images of two originals on a single sheet of copy paper, and being capable of automatic paper feeding and manual paper feeding.

A further object of the present invention is to prevent operation misses in a copying apparatus having a function of copying images of two originals on a single sheet of paper, and being capable of automatic paper feeding and manual paper feeding.

A still further object of the present invention is to improve readiness of operation in a copying apparatus having a function of copying images of two originals on a single sheet of copy paper, and being capable of automatic paper feeding and manual paper feeding.

In order to attain the above described objects, the copying apparatus of the present invention comprises, in an aspect, an original tray on which a plurality of originals can be placed; conveying mode selecting means for selecting a first mode or a second mode; conveying means for taking out, in the first mode, one original at a time out of the plurality of originals placed on the original tray to set the same at an exposure position, and for taking, in the second mode, two originals continuously out of the plurality of originals placed on the original tray to set the same at the exposure position; automatic paper feeding means for automatically feeding sheets of copy paper of a prescribed size one by one; manual paper feeding means capable of manually feeding a sheet of copy paper of an arbitrary size; paper feeding selection means for selecting either the automatic paper feeding means or the manual paper feeding means; and control means for prohibiting simultaneous selection of the second mode and the manual paper feeding means.

In order to attain the above described objects, the copying apparatus of the present invention comprises, in another aspect, an original tray on which a plurality of originals can be placed; conveying means for taking, in a first mode, one original at a time out of the plurality of originals placed on the original tray to set the same at an exposure position, and for taking, in a second mode, two originals continuously out of the plurality of originals placed on the original tray to set the same at the exposure position; automatic paper feeding means for automatically feeding sheets of copy paper of a prescribed size one by one; manual paper feeding means capable of manually feeding a sheet of copy paper of an arbitrary size; paper feeding selecting means for selecting either the automatic paper feeding means or the manual paper feeding means; and control means for selecting the first mode in response to a selection of the manual paper feeding means.

In the copying apparatus structured as described above, the automatic paper feeding means and the manual paper feeding means are appropriately set in correspondence with the copying mode, whereby the generation of miscopies can be prevented and the readiness of operation can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be described in the following in accordance with the following order.

1) Description of the mechanism of the copying machine
2) Description of the operation panel
3) Description of the controlling circuit, and
4) Description of the processes in the CPU.

DESCRIPTION OF THE MECHANISM OF THE COPYING MACHINE

Figure 1:
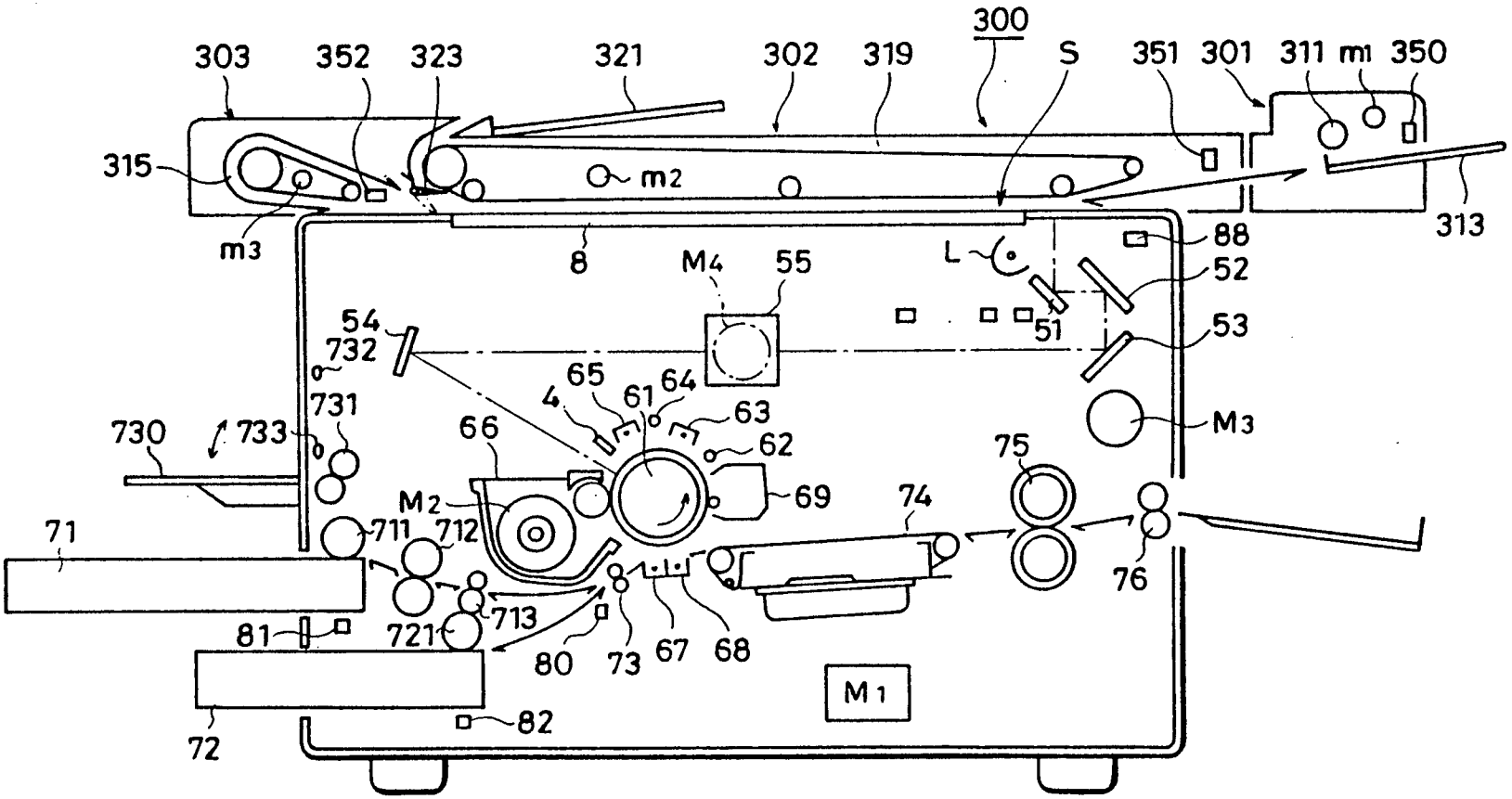
FIG. 1 is a schematic diagram showing a structure of a copying machine in accordance with one embodiment of the present invention.

FIG. 1 is a schematic diagram showing a structure a copying machine in accordance with one embodiment of the present invention.

Referring to FIG. 1, an automatic document feeder (ADF) 300 is mounted on the body of the copying machine, and the body and the ADF are electrically connected to each other.

(1) Body of the copying machine

The body of the copying machine comprises an optical system in the upper stage, and an image forming portion and a paper feeding portion arranged in the lower stage.

(i) Optical system

The optical system exposures and scans an original set on a platen glass 8 and forms images reflected from the surface of the original on a surface of a photoreceptor drum 61 in the image forming portion.

The optical system comprises an exposure lamp L, reflection mirrors 51, 52, 53 and 54, and a lens 55. The exposure lamp and the reflection mirror 51 moves at the speed of V/N (V; peripheral velocity of the photoreceptor drum 61, N; copying magnification), and the reflection mirrors 52 and 53 moves at the speed of V/2N, along the lower surface of the platen glass 8, respectively, to expose and scan the original.

Two copying magnification is set by adjusting the positions of the lens 50 and the reflection mirror 54. Correction of image forming position is done by adjusting the angle of the reflection mirror 54.

(ii) Image forming portion

The image forming portion carries out image formation in accordance with a so-called electrophotography process.

In other words, latent electrostatic images formed on the photoreceptor drum 61 are toner developed and transferred onto a sheet of copy paper, fixed thereon, and the sheet of copy paper is discharged.

The image forming portion comprises a photoreceptor drum 61 rotatably supported in the counter clockwise direction, erase lamps 62 and 64, corona chargers 63 and 65, an eraser 4, a developing apparatus 66, a transfer charger 67, a separation charger 68 and a cleaning apparatus 69 arranged along the photoreceptor drum 61, conveyor belt 74 for conveying a sheet of copy paper on which the images are transferred, and a fixing apparatus 75 for fixing the toner images on the conveyed sheet. A timing roller pair 73 transmit a fed sheet of copy paper to the photoreceptor drum 61 to the transfer charger 67 at a prescribed timing in synchronization with the rotation of the photoreceptor drum. A roller pair 76 discharges the sheet of copy paper on which images are fixed from the image forming portion.

(iii) Paper feeding portion

The paper feeding portion comprises an upper paper feeding cassette 71 and a lower paper feeding cassette 72 containing sheets of copy paper of different sizes. The size of the paper and the direction of setting of the respective cassettes are detected by size detecting switches 81 and 82. The detection signals are utilized when the sheets of paper are automatically selected, for instance.

The sheet of paper in the cassette 71 is drawn out by a paper feeding roller 711 and fed to the timing roller pair 73 of the image forming portion by the roller pairs 712 and 713. The sheet in the cassette 72 is drawn out by a paper feeding roller 721 and fed to the timing roller pair 73.

The fed sheet of paper is detected by a sensor 80 before the roller. Thereafter, in response to a prescribed the timing signal from the optical system, the sheet is fed to the photoreceptor drum 61 and to the transfer charger 67 in synchronization with the rotation of the photoreceptor drum 61, where the image forming process is carried out.

A manual feed tray 730 is provided above the paper feeding cassette 71, which tray can be opened and closed to the sidewall of the body. The open/closed state is detected by the manual feed detecting switch 732.

When the open state of the manual feed tray 730 is detected by the manual feed detecting switch 732, the manual feed copy mode is set in this embodiment. However, the present invention is not limited to this embodiment. For example, the manual feed copy mode may be set by detecting a sheet of copy paper by using a sensor, when a copy paper is inserted to the manual paper feeding inlet. A manual feed mode setting key may be separately provided.

The sheet of copy paper inserted from the manual feed tray 730 is detected by a sheet detecting sensor 733, whereby a clutch of the paper feeding roller 731 is turned ON, and the paper feeding by the paper feeding roller 731 is started (see copy operation routine).

(2) ADF 300

The ADF 300 comprises an original mounting portion 301, an original conveying portion 302 and an original inverting portion 303.

When the 2 in 1 mode is set, the ADF 300 feeds two originals continuously from the original mounting portion 301 to the platen glass 8.

The paper feeding operation is carried out with the paper feeding timing of both originals adjusted so that the rear end of the latter fed original is regulated at a position of an original scale S and the rear end of the former fed original coincides with the front edge of the latter fed original. Thereafter, exposure and the scanning of the original images are carried out.

(i) Original mounting portion 301

The original mounting portion 301 comprises an original tray 313, an original feeding roller 311, a driving motor m1 for driving the roller 311 and an original presence/absence detecting sensor 350 for detecting the presence/absence of the original on the tray 313.

(ii) Original conveying portion 302

The original conveying portion 302 positions the original fed from the mounting portion 301 at a prescribed position on the platen glass 8, and discharges the original after the copying operation.

The original conveying portion 302 comprises an original conveyor belt 319, a belt driving motor m2 and an original feed detecting sensor 351 for detecting front and rear ends of the original fed thereto, and an original discharging tray 321 is arranged thereabove. An original size detecting sensor may be provided separately from the original feed detecting sensor 351.

(iii) Original inverting portion 303

The original inverting portion 303 inverts the sides of the original, with images formed on both sides on the original, fed from the original conveying portion 302 and return the original to the conveying portion 302.

The original inverting portion 303 comprises an inversion conveying belt 315, a belt driving motor m3, a switching lever 323 and an original passage detecting sensor 352.

It is switched by a switching lever 323 operated by a solenoid whether the original is to be discharged to the discharge tray 321 from the conveying portion 302 or to be fed to the inverting portion 303.

(iv) The ADF starts feeding of the original in response to an ADF start signal transmitted from the controlling CPU of the body of the copying machine, for example, and when the original is set at the prescribed position on the platen glass 8, it transmits an original prescribed position equal to the CPU. Consequently, operation at prescribed timing is realized.

DESCRIPTION OF THE OPERATION PANEL

Figure 2:
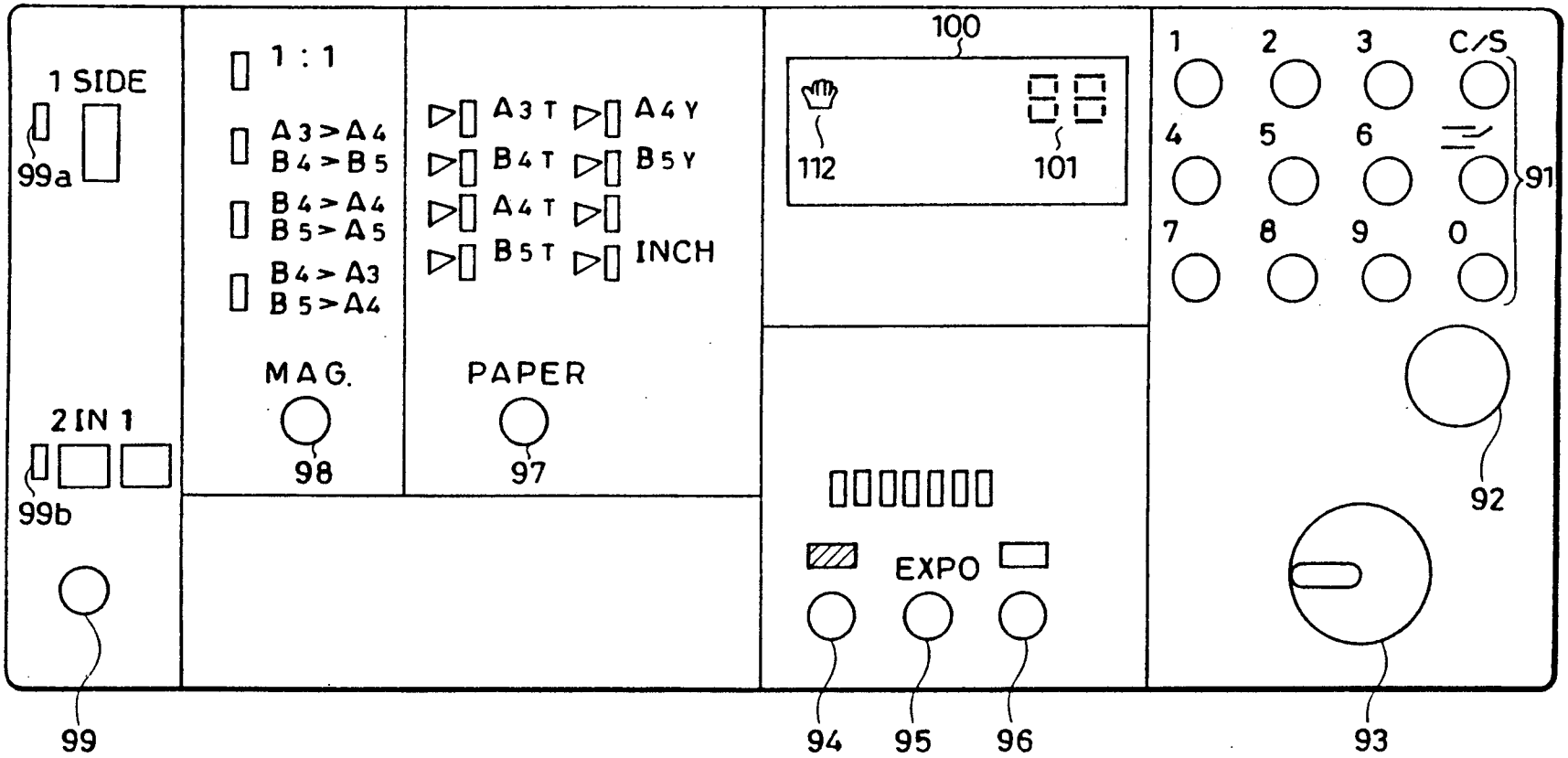
FIG. 2 is a plan view showing operation panel of the copying machine shown in FIG. 1.

FIG. 2 shows the operation panel of the copying machine.

On the operation panel, arranged are: a key unit 91 including a ten-key group for inputting numerals 0 to 9, a clear/stop key and an interruption key; an all reset key 92 for designating reset of all modes to the initial state; a start key 93 for instructing a start of the copying operation and the like; an exposure automatic key 95 for instructing automatic setting mode of the exposure amount; an exposure upkey 94 for instructing increase of the exposure amount; an exposure down key 96 for instructing decrease of the exposure amount; a PAPER KEY 97 for selecting the size and the setting direction of the copy paper; a MAG KEY 98 for selecting copying magnification; a mode select key 99 for successively selecting the 2 in 1 mode/normal mode (signal side on sheet feeding mode); a normal mode display LED **99*a* indicating, when lighted, the selection of the normal mode (single side one sheet feeding mode); a 2 in 1 mode display LED 99*b*** indicating, when lighted, selection of the 2 in 1 mode; and so on.

A liquid crystal displaying portion 100 is arranged above the exposure amount setting key group 94 to 96 as viewed in the figure. The liquid crystal displaying portion 100 displays, for example, manual feed display 112 displaying the selection of the manual feeding mode, numeral display 101 displaying numerals such as the number of copying, and so on.

DESCRIPTION OF THE CONTROLLING CIRCUIT

Figure 3:
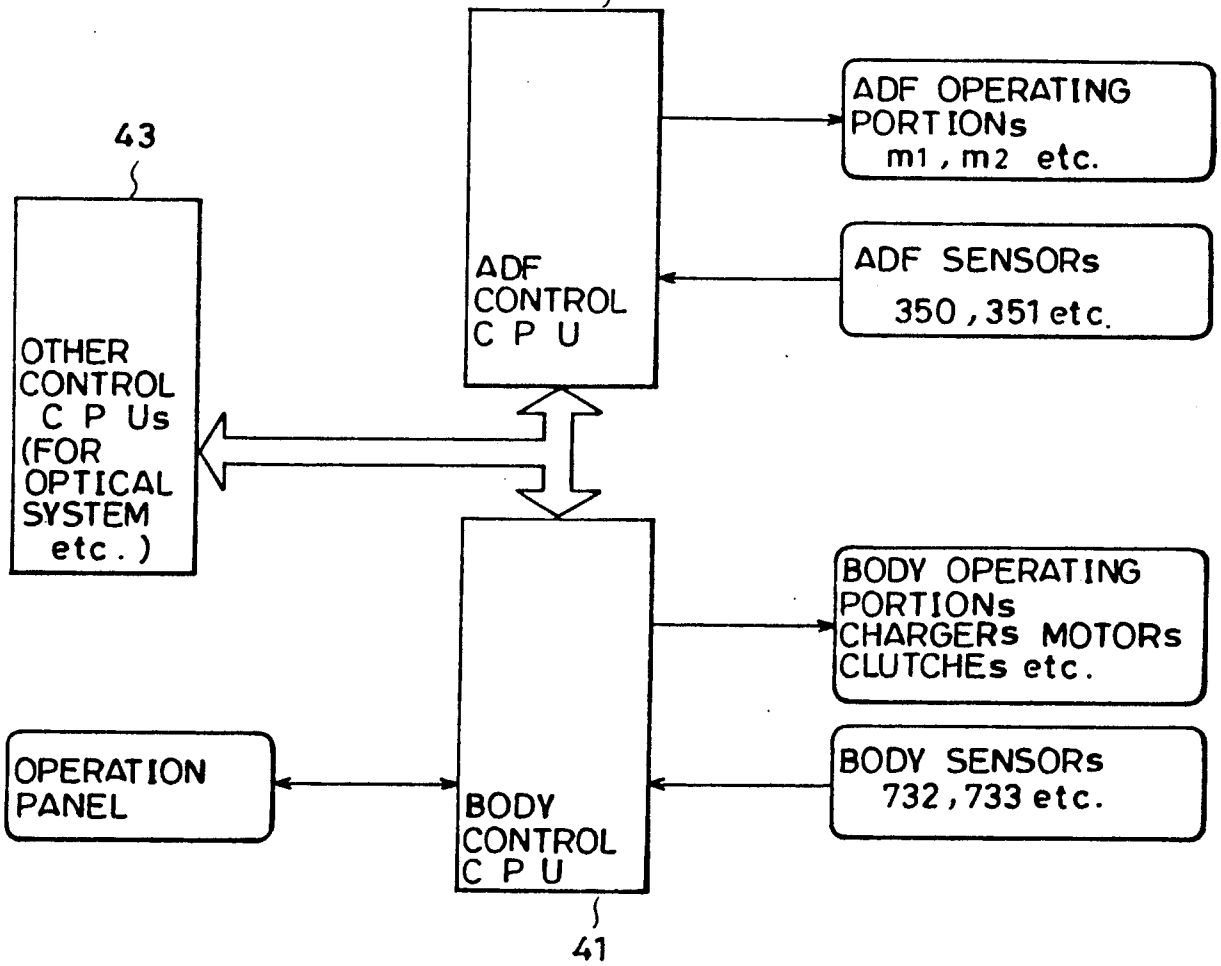
FIG. 3 is a block diagram of a controlling circuit of the copying machine shown in FIG. 1.
Figure 4A:
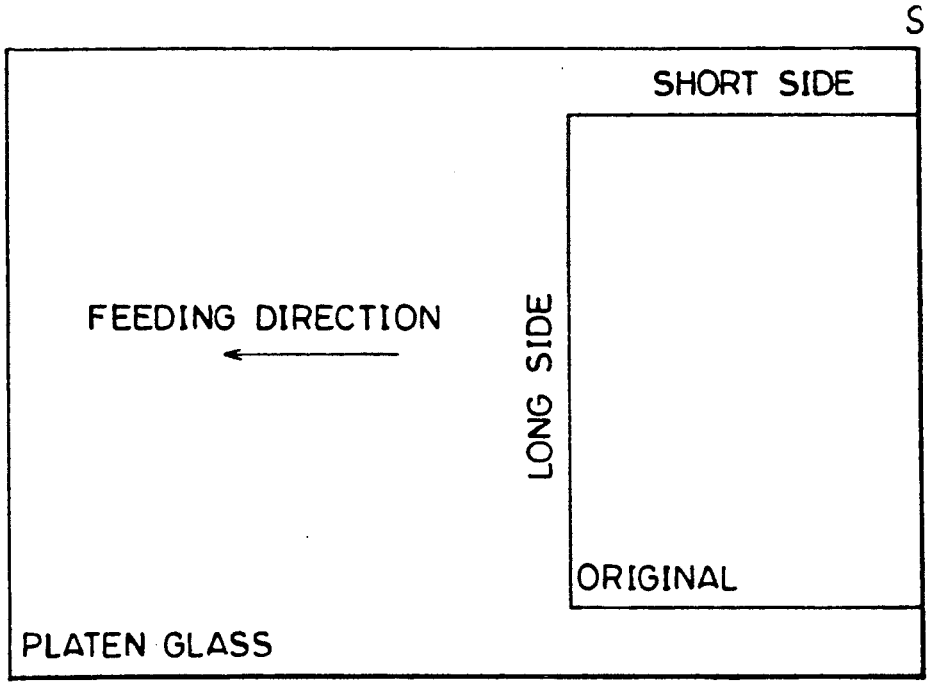
FIGS. 4A and 4B show directions of setting originals in accordance with one embodiment of the present invention.
Figure 4B:
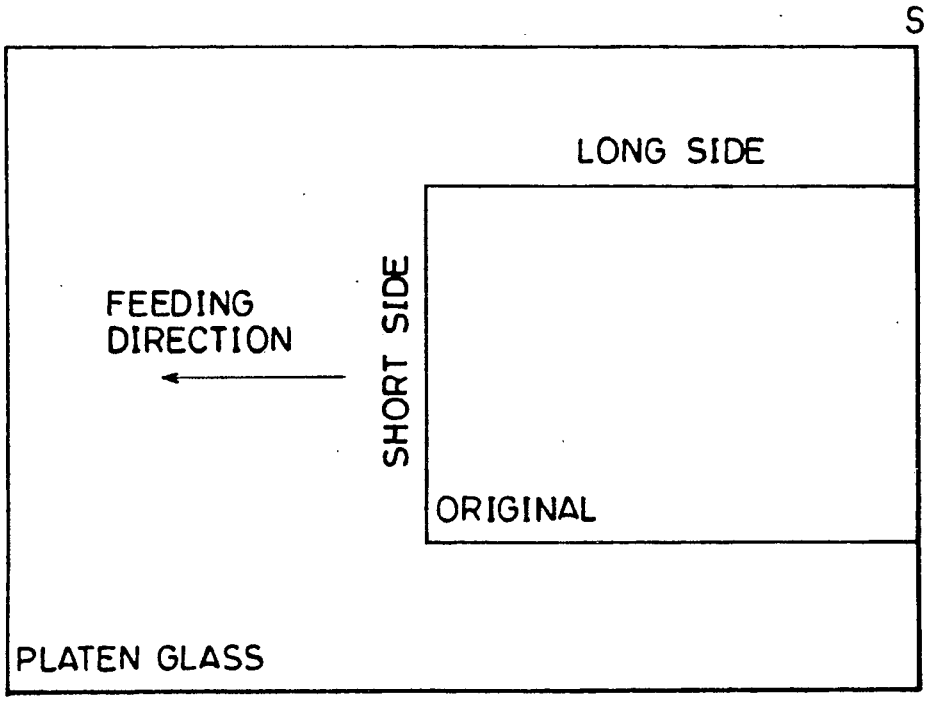

FIG. 3 is a block diagram showing a structure of the controlling circuit of the copying machine shown in FIG. 1.

As shown in the figure, the controlling circuit is mainly comprised of a body control CPU 41 for controlling the operation of the body of the copying machine and an ADF control CPU 42 for controlling the operation of the ADF.

Signals from the keys on the operation panel and from the group of sensors (for example, manual feed tray open/close detection switch 732, manual feed detecting sensor 733 and so on) arranged in the body are inputted to the body control CPU 41.

Driving signals to various displaying portions (for example, manual feed display 112 and so on) and to various displaying elements (for example, 2 in 1 mode display 99*b* and so on) on the operation panel and driving control signals to various operating portions (for example, motors such as the main motor M1, clutches such as paper feeding clutches, chargers such as corona chargers, feeders such as the fixing apparatus 75) in the body are outputted from the body controlling CPU 41.

Signals from sensors (sensors 350, 351 and so) arranged at various portions of the ADF are inputted to the ADF controlling CPU 42. Drive control signals to motors (m1, m2 and so on) driving the conveyor belt, paper feeding roller and the like of the ADF are outputted from the CPU 42.

The above described body control CPU 41 and the ADF control CPU 42 communicate with each other while carrying out controls such as described in the following. CPUs controlling the optical system and so on are collectively represented by other CPU group 43 in the figure.

DESCRIPTION OF THE PROCESSES IN THE CPU

The operation of the apparatus of the embodiment will be described with reference to the processes in the body controlling CPU 41 and the ADF controlling CPU 42.

In the following description, the term "ON edge" means a change of a signal state from OFF state to the On state, and "OFF edge" means a change of the state of the signal from ON state to the OFF state.

[A] BODY CONTROLLING CPU 41

Main Routine

Figure 5:
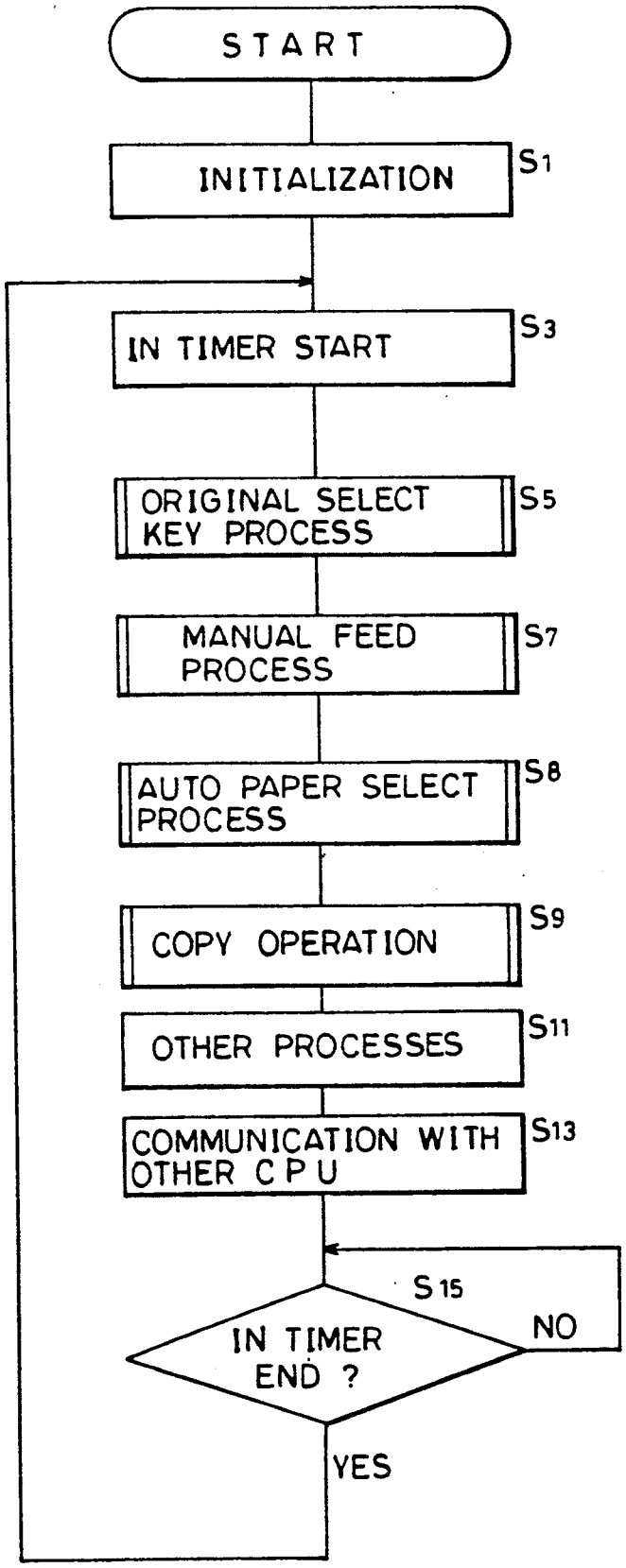
FIG. 5 is a flow chart showing a main routine of processing of a body control CPU of FIG. 3.

FIG. 5 is a flow chart showing a main routine of the process in the body controlling CPU 41 in accordance with one embodiment of the present invention.

The body controlling CPU 41 starts processing when the power is turned on, for instance, and initializes various registers, flags and son on (S1).

In the step S3, an internal timer defining the time of execution of 1 routine is started.

An original selection key process (S5), manual feed process (S7), automatic paper selection process (S8) and copy operation process (S9) are successively called. These processes will be described in detail later.

Other processes (S11: processes other than the above described processes carried out in the CPU 41) and communication process (S13) with other controlling CPUs are carried out.

Thereafter, in the step S15, the flow waits for the end of operation of the internal timer, and the program returns to the step S3 to repeat the above processes.

Original Selection Key Process

Figure 6:
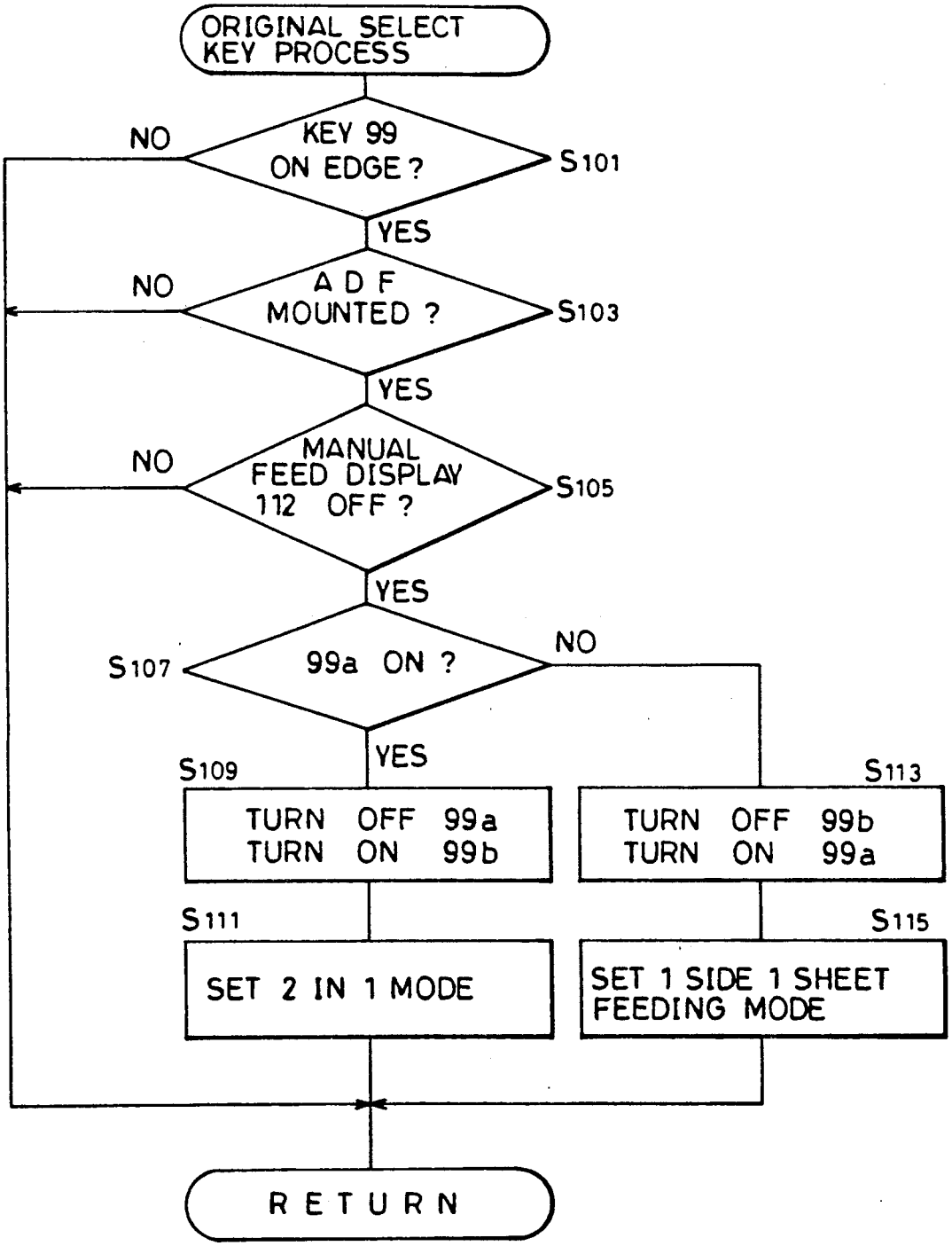
FIG. 6 is a flow chart showing specific contents of an original selection key process of FIG. 5.
Figure 7:
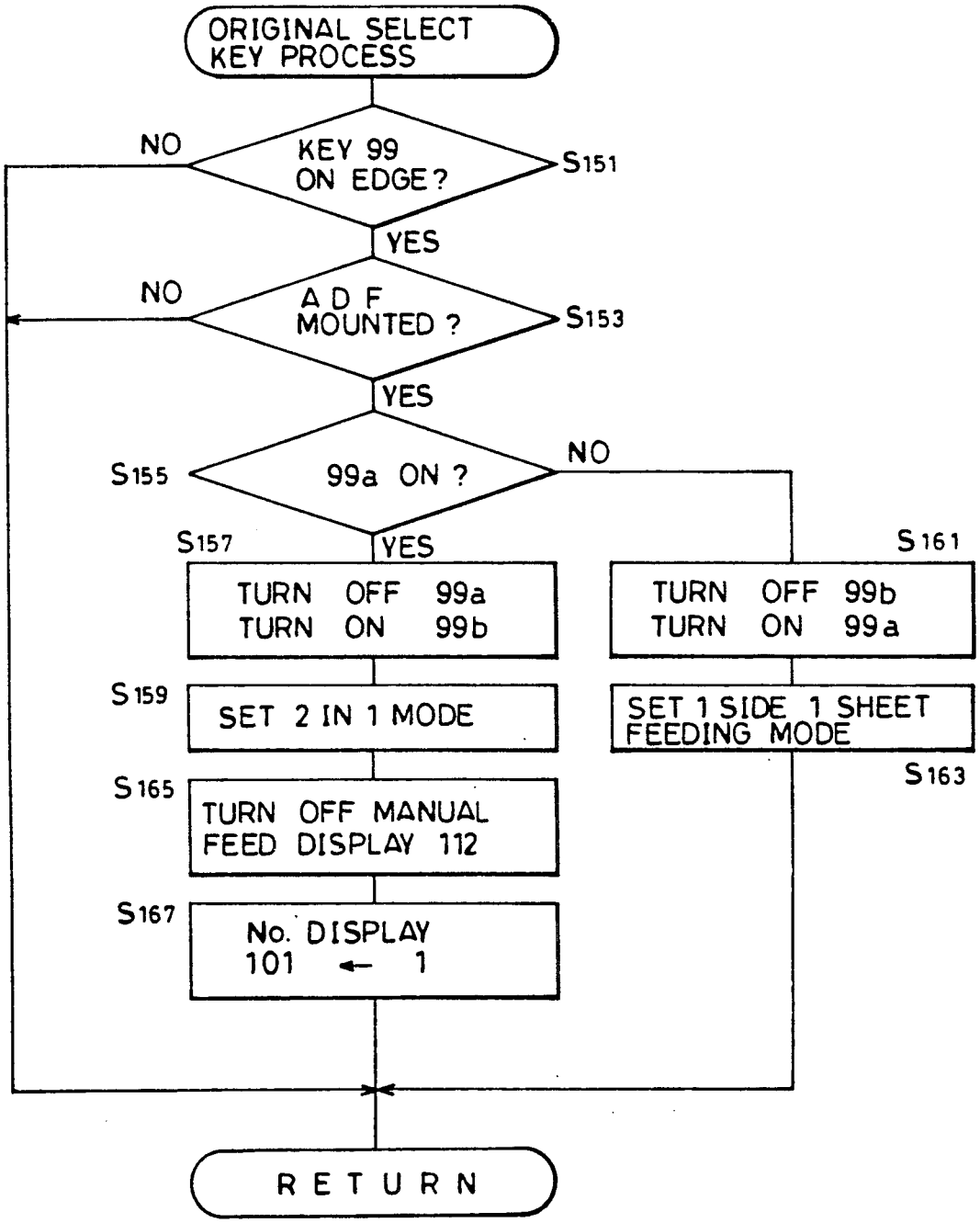
FIG. 7 is a flow chart showing specific contents of an original selection key process shown in FIG. 5.

FIG. 6 is a flow chart showing one embodiment of the specific content of the original selection key process (S5) of FIG. 5. FIG. 7 is a flow chart showing another embodiment of the original selection key process (S5).

i) Embodiment of FIG. 6

If an ON edge of the mode select key 99 is detected (YES in S101) and the ADF 300 is mounted (YES in S103), then whether or not the manual feeding mode is set is determined in the step S105.

If the manual feeding mode is set (NO in S105), then the input of the mode select key 99 is neglected, and the program returns to the main routine.

If the manual feeding mode is not set in the step S105 (YES is S105), the program proceeds to the step S107 in which it is determined whether the original feeding mode is the 2 in 1 mode or the normal (single side one sheet feeding) mode.

If it is the 2 in 1 mode (NO in S107), then the states of the display LEDs 99*a* and 99*b* are switched, the 2 in 1 mode is canceled and the normal (single side one sheet feeding) mode is set (S113, S115). If it is the normal (single side one sheet feeding) mode (YES in S107), the states of the display LEDs 99*a* and 99*b* are switched, the normal (single side one sheet feeding) mode is canceled and the 2 in 1 mode is set (S109, S111).

In the process of the embodiment shown in FIG. 6, when the manual feeding mode is set, the priority is given to the manual feeding mode, and the input of the mode select key 99 is neglected.

ii) Embodiment of FIG. 7

If an ON edge of the mode select key 99 is detected (YES in S151) and the ADF 300 is mounted (YES in S153), the program proceeds to the step S155 in which it is determined whether the original feeding mode is the 2 in 1 mode or the normal (single side one sheet feeding) mode.

If it is the normal (single side one sheet feeding) mode (YES in S155), the normal (single side one sheet feeding) mode is canceled and the 2 in 1 mode is set (S157, S159). Then, the manual feed mode is canceled (S165) and the numeral display 101 is set to "1" (S167).

If it is the 2 in 1 mode (NO in S155), the 2 in 1 mode is canceled and the normal (single side one sheet feeding) mode is set (S161, S163).

In this manner, in the embodiment of FIG. 7, when the 2 in 1 mode is designated by the input of the original selection key 99, the 2 in 1 mode is given priority and the manual feeding mode is canceled.

Manual Feed Door Process

Figure 8:
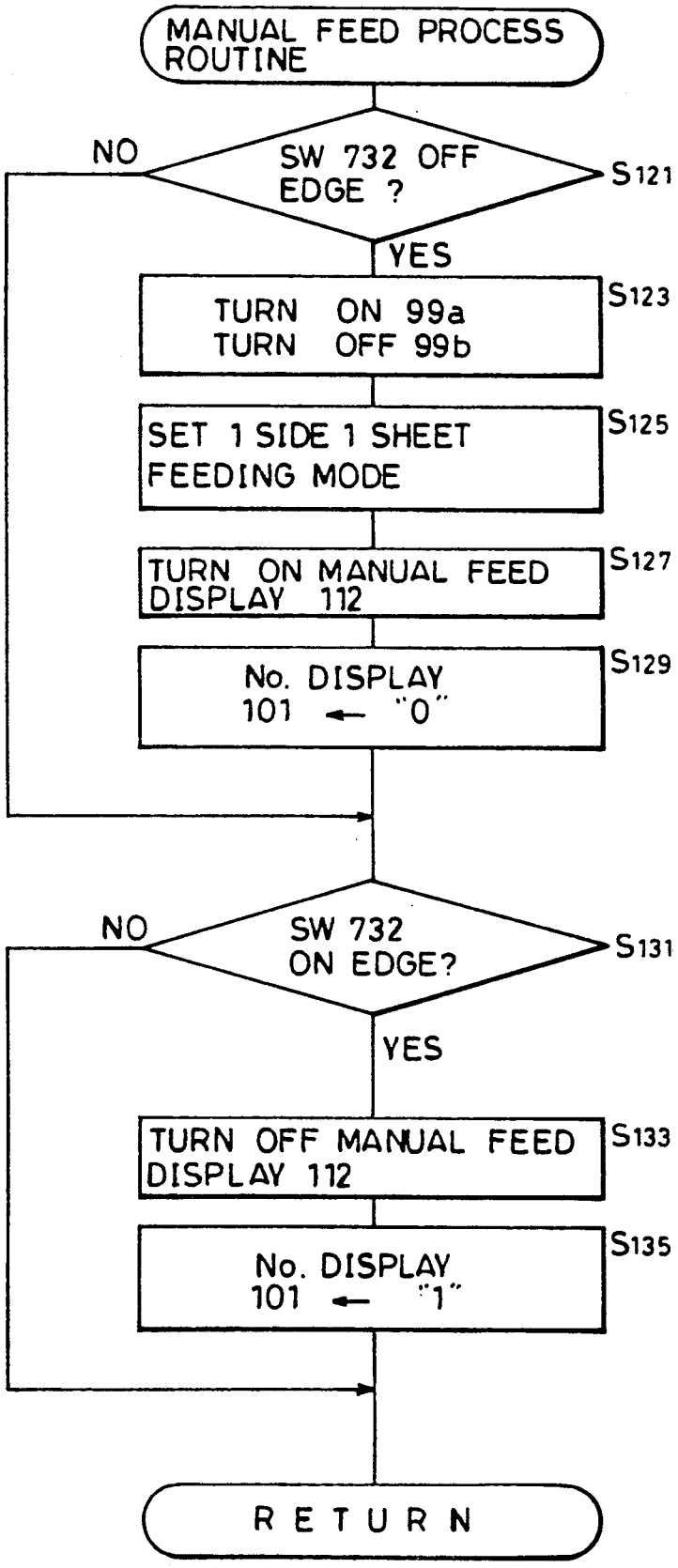
FIG. 8 is a flow chart showing specific contents of one embodiment of a manual feed processing routine of FIG. 5.
Figure 9:
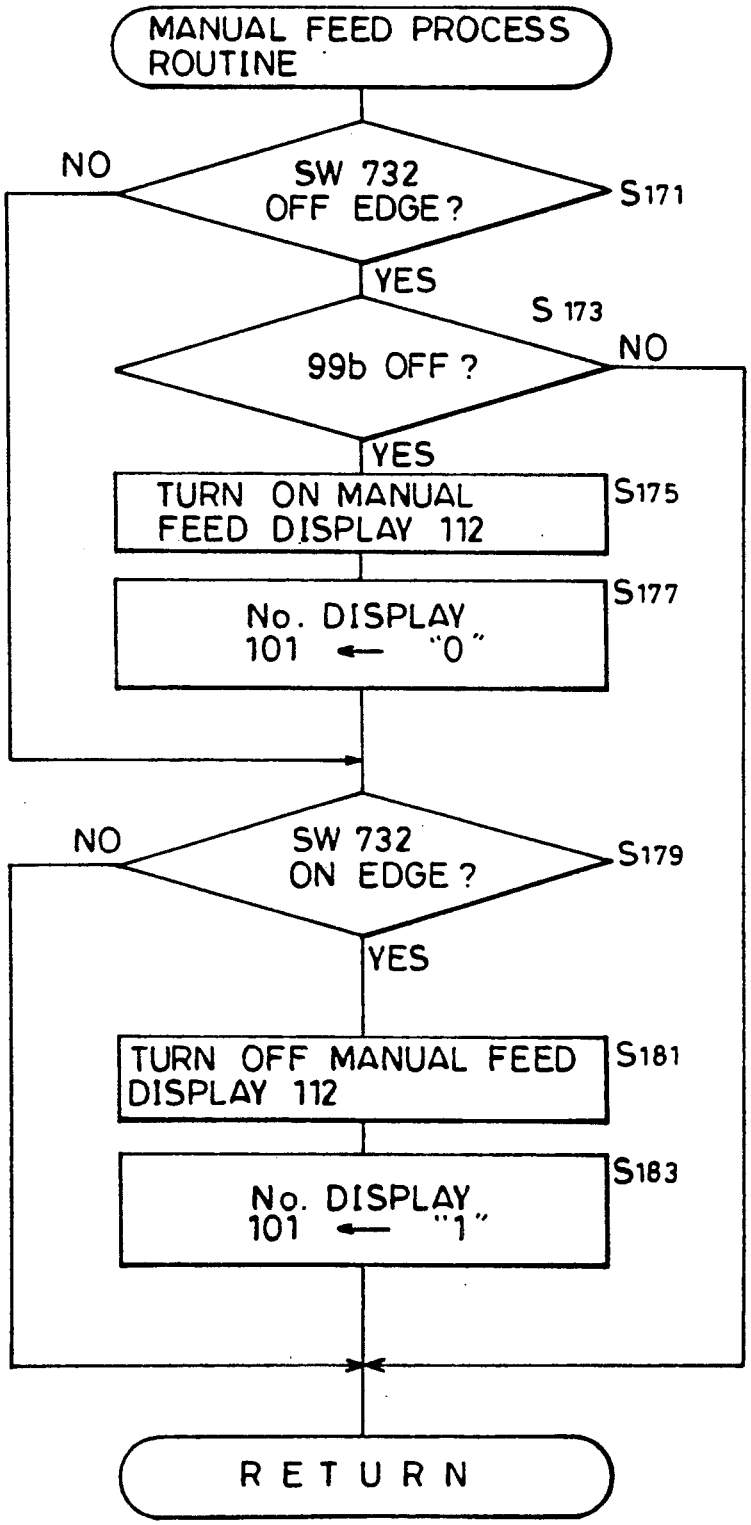
FIG. 9 is a flow chart showing specific contents of another embodiment of the manual feed processing routine of FIG. 5.

FIG. 8 is a flow chart showing an embodiment of the specific content of the manual feed process (S7) of FIG. 5. FIG. 9 is a flow chart showing another embodiment of the manual feed process (S7).

i) Embodiment of FIG. 8

When the manual feed tray 730 is opened (S121, YES), the original feeding mode is set to the "signal side one sheet feeding mode" (S123, S125). Then, the manual fed mode is set (S127), and the numeral display 101 is set to "0" (S129).

If the manual feed tray 730 is closed (YES in S131), the manual feed mode is canceled (S133) and the numeral display 101 is set to "1" (S135).

In this manner, in the embodiment of FIG. 8, the setting of the cancellation of the manual feed mode is carried out corresponding to the opening/closing of the manual feed tray 730 (the opening and closing are detected by the manual feed detection switch 732), and when the manual feeding mode is set, the original feeding mode is forcedly set to the "signal side one sheet feeding mode".

ii) Embodiment of FIG. 9

When the manual feed tray 730 is opened (YES is S171), then whether or not the 2 in 1 mode is set is determined (S173).

If the 2 in 1 mode is set (NO in S173), the opening of the manual feed tray 730 is neglected, and the program returns to the main routine.

If it is determined in the step S173 that the 2 in 1 mode is not set (YES in S173), then the manual feed mode is set (S175). The numeral display 101 is set to "0" (S177).

If the manual feed tray 730 is closed (YES in S179), the manual feed mode is canceled (S181) and the numeral display 101 is set to "1" (S183).

In this manner, in the embodiment of FIG. 9, when the manual feed tray 730 is opened and the 2 in 1 mode is set. the 2 in 1 mode is given priority, and the opening of the manual feed tray 730 is neglected.

The automatic paper selection process (S8) of FIG. 5 will be described later.

Copy Operation Routine

Figure 10A:
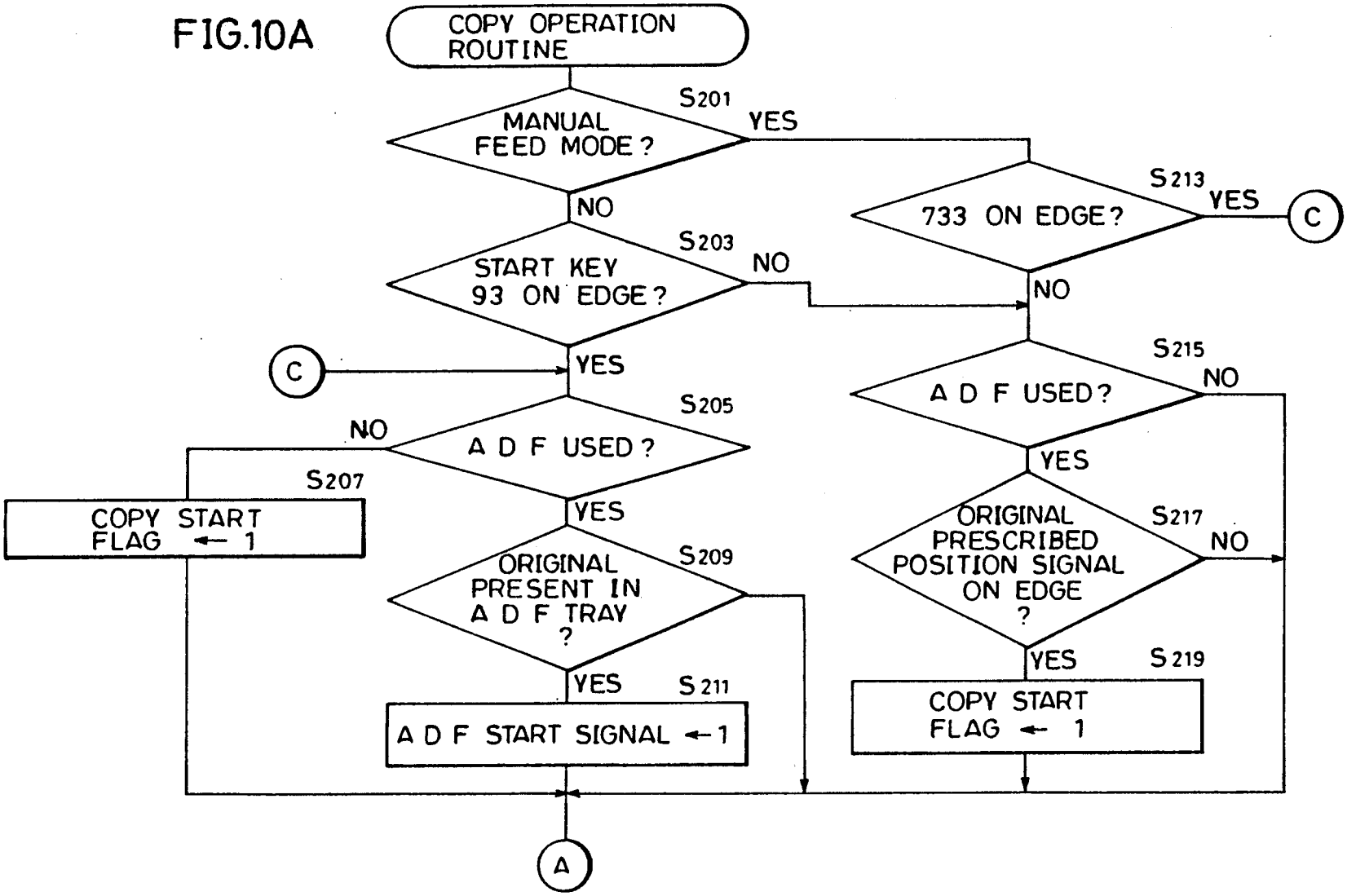
FIGS. 10A to 10C are flow charts showing specific contents of a copy operation routine of FIG. 5.
Figure 10B:
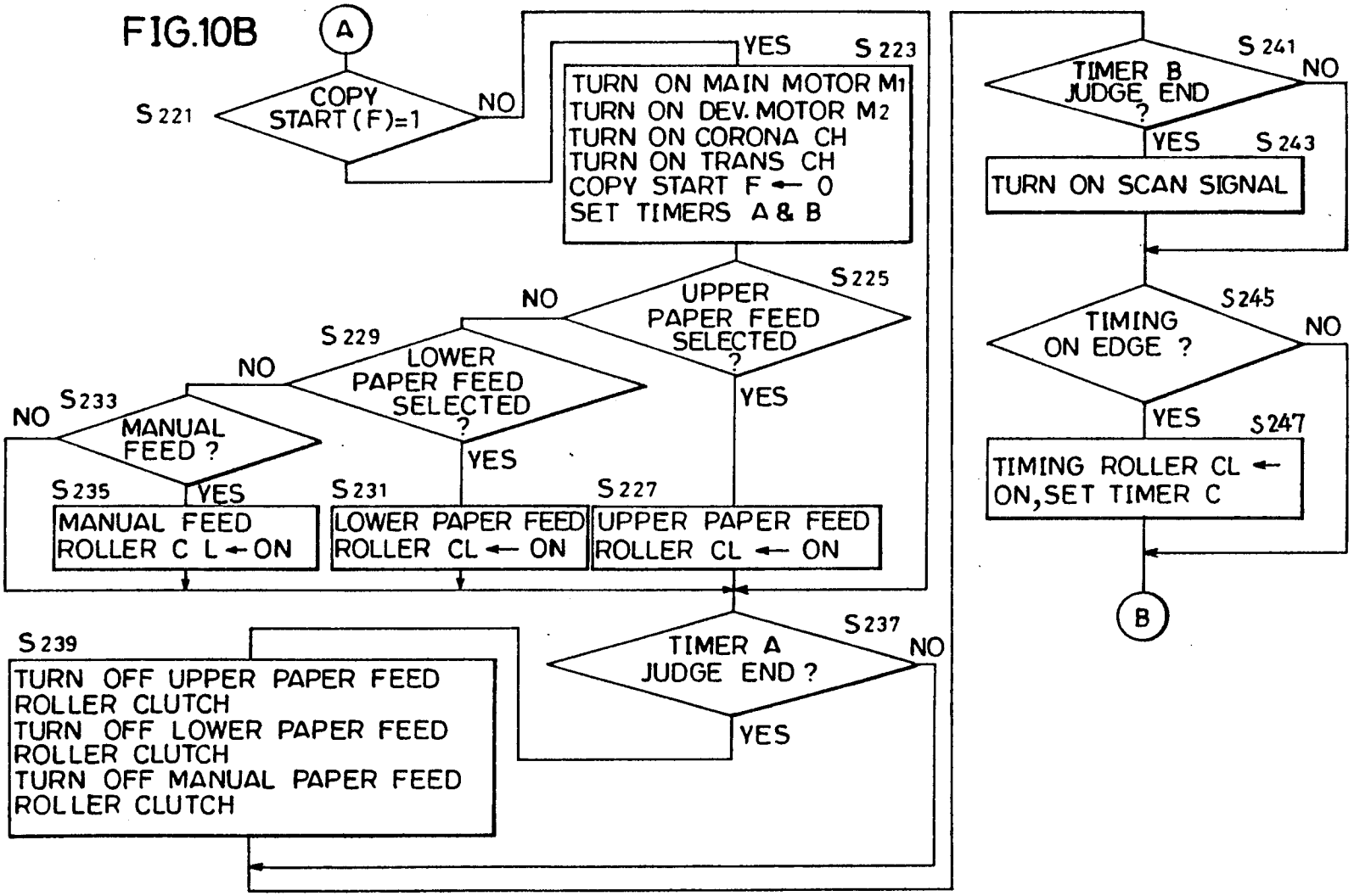
Figure 10C:
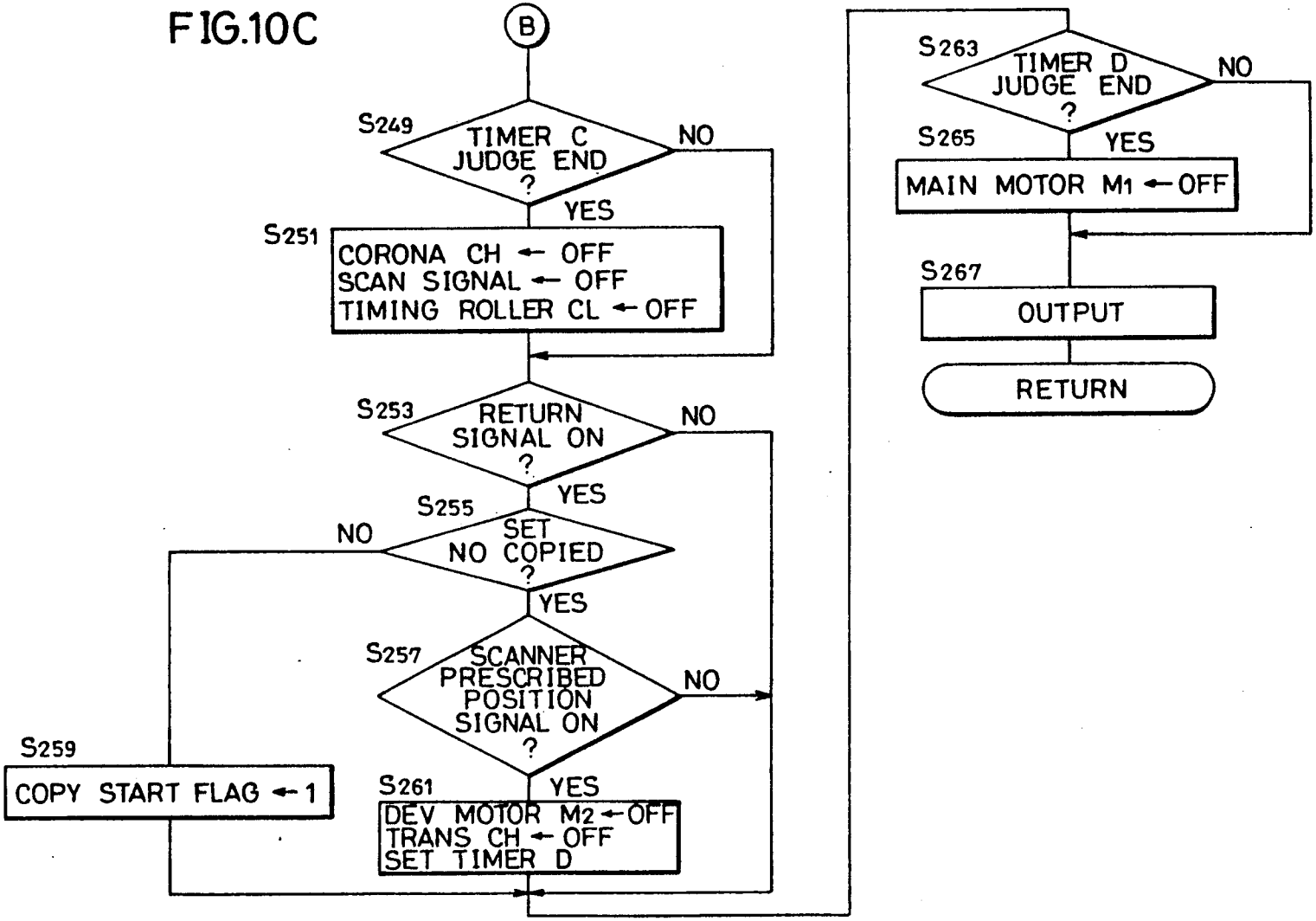

FIGS. 10A to 10C are flow charts showing the copy operation routine (S9) of FIG. 5.

Steps S201 to S219 are the processes when a copy start instruction is detected. The copy start instruction is given when the start key 93 is turned on or when a sheet of copy paper is inserted in the manual feed inlet.

When the sheet of copy paper is inserted through the manual feed paper inlet (YES in S213), the program proceeds to the step S205 to determine whether or not the ADF is used. If it is determined that the ADF is not used (NO in S205), a copy start flag is immediately set (S207) and the copying operation is carried out. If the ADF is to be used (YES in S205), the program waits for the setting of originals in the ADF (YES in S209) and then an ADF start signal is generated (S211), whereby the feeding of the original is started.

If an ON edge of the start key 93 is detected (YES in S203), the program also proceeds to the step S205 in which whether the ADF is to be used or not is determined. If the ADF is not used (NO in S205), the copy start flag is immediately set (S207) and the copying operation is started. Meanwhile, if the ADF is to be used (YES in S205), the program waits for the setting of the original in the ADF (YES in S209), an ADF start signal is generated (S211), and the feeding of originals is started.

The steps S215 to S219 are processes for waiting the completion of feeding of the original and for setting the copy start flag (S219) at the completion of feeding (YES in S217) to start the copying operation.

The steps S221 to S235 are processes at the start of copying operation.

When the copy start flag is set (YES in S221), the main motor, the developing motor, the corona charger and the transfer charger are turned ON, timers A and B are set, and the copy start flag is reset (S223).

The clutch of the paper feeding roller at the selected paper feeding inlet is turned ON to start feeding of the sheets of copy paper (S225 to S235).

In the steps S237 to S251, timing of the image forming process is controlled.

At the time up of the timer A (YES in S237), the clutch of the paper feeding roller is turned OFF to stop the rotation thereof (S239).

At the time up of the timer B (YES in S241), the exposure and scanning of the optical system is started (S243).

If a timing signal from the optical system is detected (YES in S245), the clutch of the timing roller 73 is turned on and the copy paper is fed to the photoreceptor drum 61. The timer C is set (S247).

At the time up of the timer C (YES is S249), the corona charger and the clutch of the timing roller 73 are turned OFF, and the exposure and scanning are completed (S251).

The steps S245 to S265 are processes to be ready for the next copying operation or for finishing the copying operation. When a return signal from the optical system is detected (S253), whether or not the copying operation for the set number of copies is done is determined (S255). If the copying operation for the set number of copies is not yet completed (NO in S255), then the copy start flag is set again (S259) to be ready for the next copying operation.

If the copying operation for the set number of copies is finished (YES in S255), then, after the scanner of the optical system is returned to the prescribed position (YES in S257), the developing motor and the transfer charger are turned OFF and a timer D is set (S261).

At the time up of the timer D (YES in S263), the main motor M1 is turned OFF and the copying operation is finished (S265).

The step S267 is to carry out the output process.

[B] ADF CONTROLLING CPU 42

Main Routine

Figure 11A:
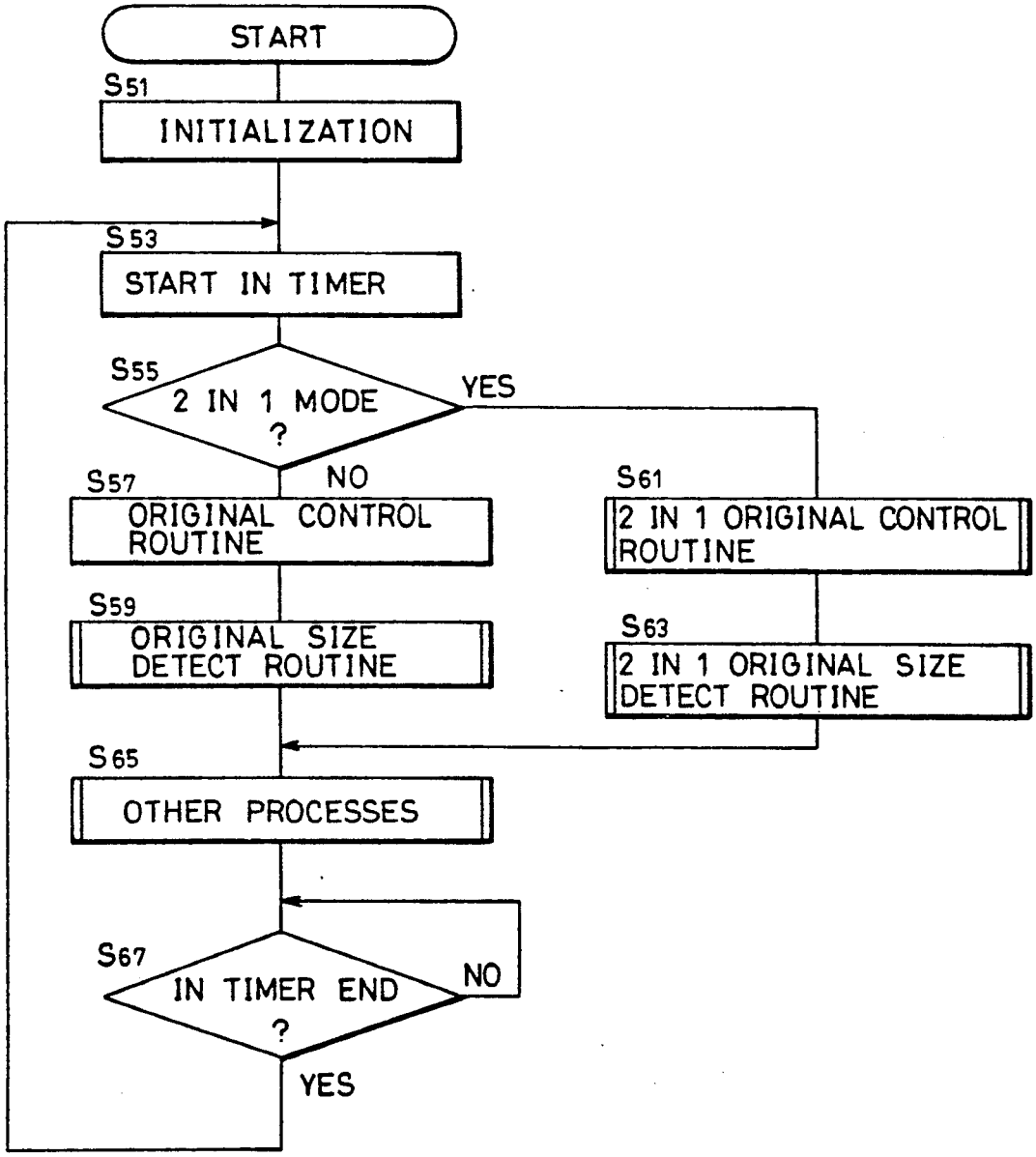
FIG. 11A is a flow chart showing a main routine of processing of an ADF control CPU of FIG. 3.
Figure 11B:
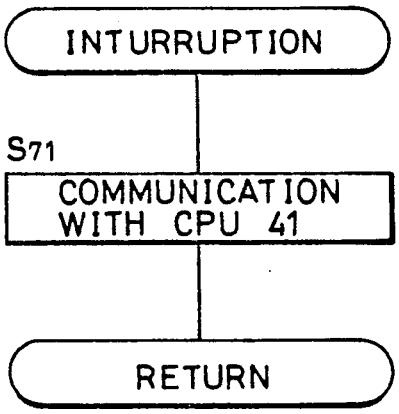
FIG. 11B is a flow chart showing contents of an interruption routine of the ADF control CPU of FIG. 3.

FIG. 11A is a flow chart showing the main routine of the ADF controlling CPU 42 and FIG. 11B shows a flow chart of a communication interruption routine.

First, initialization is done in the step S51, and an internal timer defining the time of executing 1 routine is started in the step S53.

In the step S55, whether or not the 2 in 1 mode is set is determined.

If the 2 in 1 mode is set (YES in S55), the 2 in 1 original control routine (S61) and the 2 in 1 original size detecting routine (S63) are executed.

If it is determined that it is not the 2 in 1 mode (NO in S55), an original control routine (S57) and an original size detecting routine (S59) are executed.

The step S65 shows collectively the processes other than the above described processes.

Thereafter, in the step S67, the program waits for the end of the operation of the internal timer, the program returns to the step S53 and the above processes are repeated.

In the interruption routine, communication with the body controlling CPU 41 is carried out as needed in the step S71, as shown in FIG. 11B.

The details of the 2 in 1 original control routine (S61) and the 2 in 1 original size detecting routine (S63) will be described in the following with reference to the time charts.

2 in 1 Original Control Routine

Figure 12A:
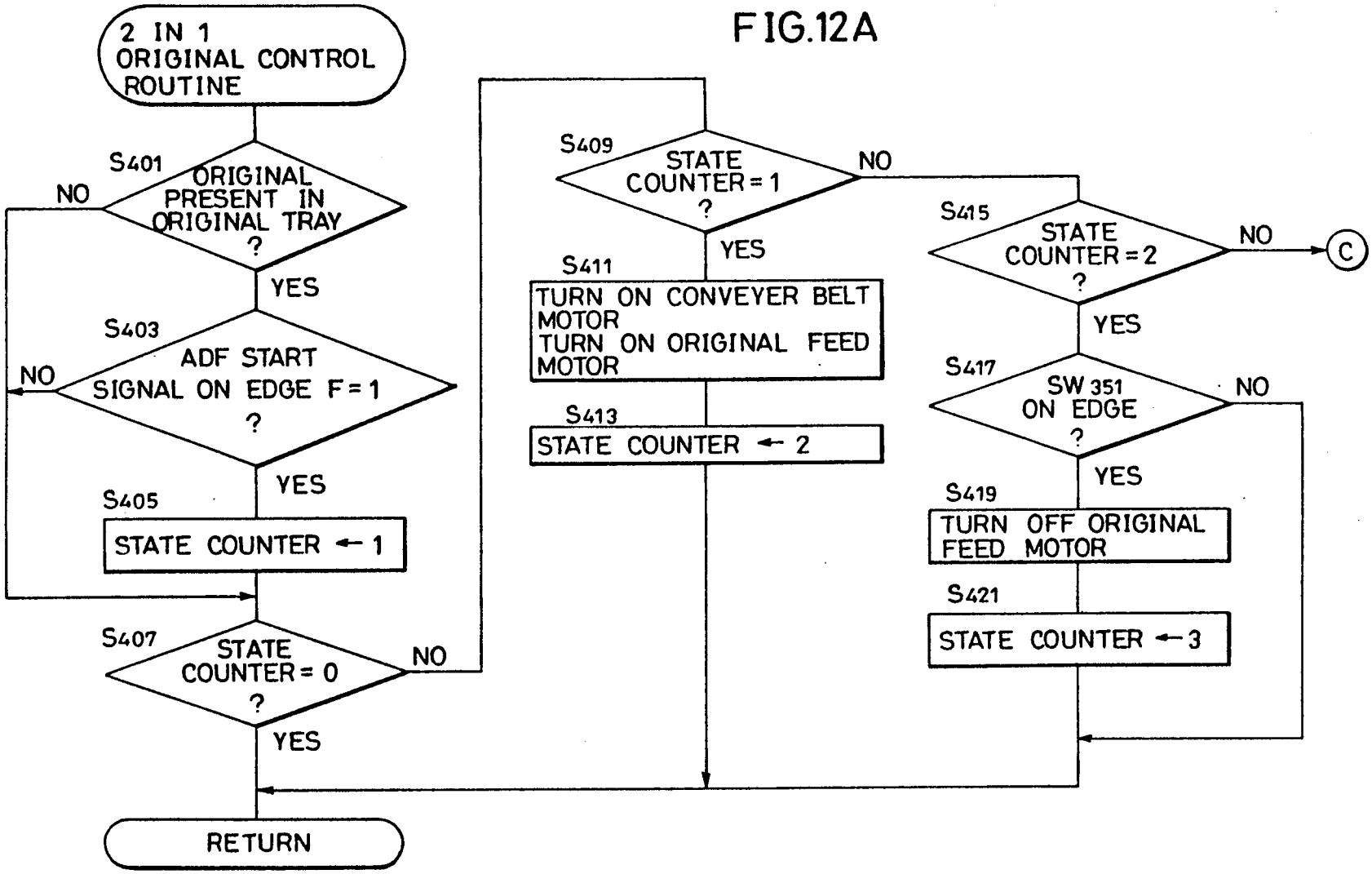
FIGS. 12A to 12C are flow charts showing specific contents of a 2 in 1 original control routine of FIG. 11A.
Figure 12B:
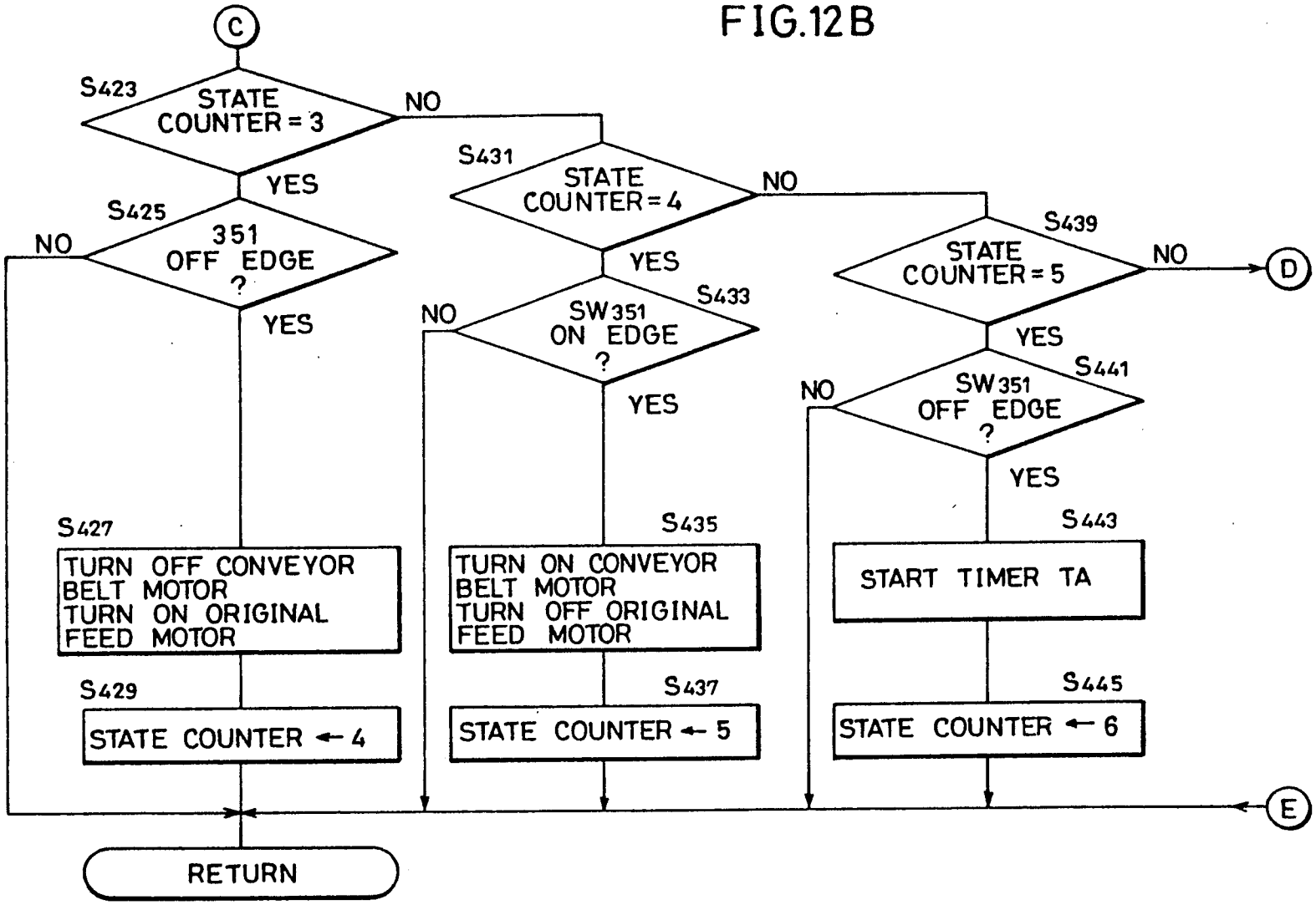
Figure 12C:
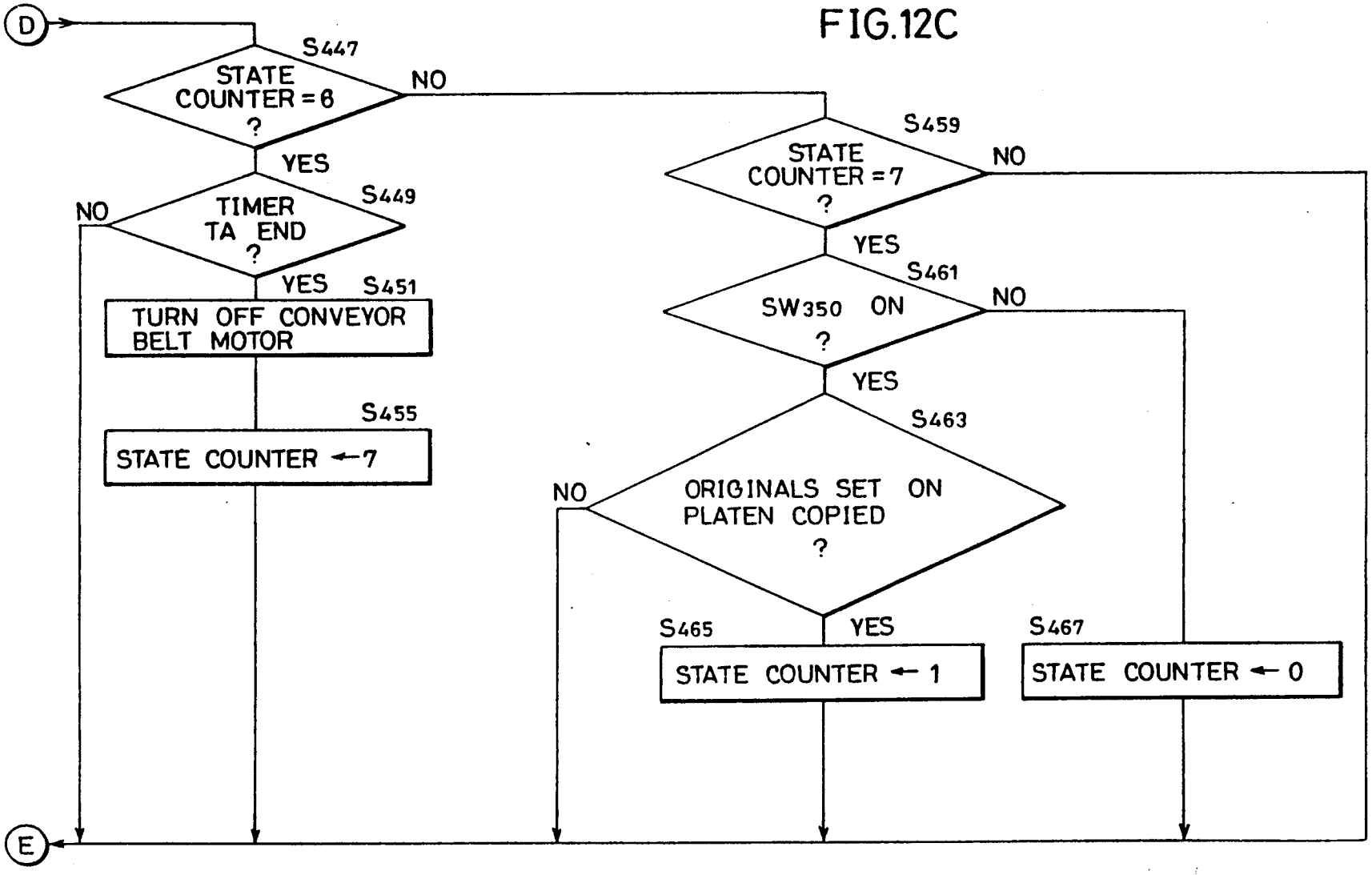
Figure 14:
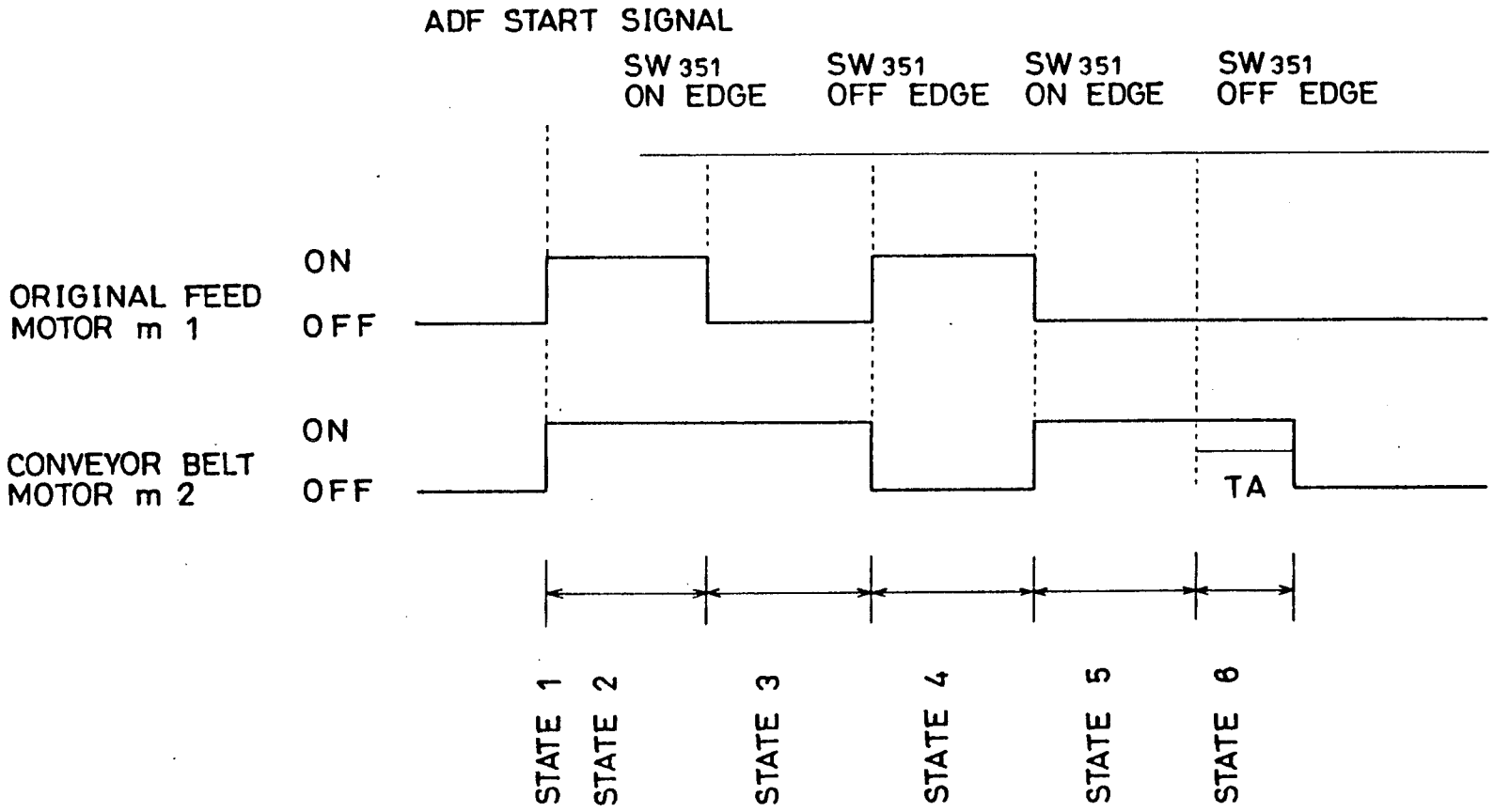
FIG. 14 is a time chart showing the states of FIG. 12 and the ON edge and OFF edge of the switch SW351 shown in FIG. 1.

FIGS. 12A, 12B and 12C are the flow charts showing specific contents of the 2 in 1 original control routine (S61) of FIG. 11A. FIG. 14 is a time chart showing correspondence between ON/OFF of the switch 351 in FIG. 1 and a state counter shown in FIG. 12.

When originals are set in the original tray 313 of the ADF (YES in S401) and an ADF start signal ON edge flag is set (YES in S403), 1 is set in the state counter (S405). The value of the state counter is reset to "0" in the initial state.

In the steps following the step S407, the processes are switched to be carried out in correspondence with the value of the state counter. If the state counter =0, the program directly returns to the main routine.

If the state counter is 1, the conveyor belt motor m2 and the original feeding motor m1 are turned ON (S411), the state counter is set to 2 (S413), and the program returns to the main routine.

If the state counter is 2, the program waits for the detection of an ON edge of the original feeding detection sensor 351 (YES in S417), then the original feeding motor m1 is turned OFF (S419), 3 is set in the state counter (S421), and the program returns to the main routine.

If the state counter is 3, the program waits for the detection of an OFF edge of the original feeding detection sensor 351 (YES in S425), then the conveyor belt motor m2 is turned off, and the original feeding motor m1 is turned on (S427).

4 is set in the state counter (S429), and the program returns to the main routine.

If the state counter is 4, the program waits for the detection of the ON edge of the original feeding detection sensor 351 (YES in S433), then the conveyor belt motor m2 is turned ON, and the original feeding motor m1 is turned off (S435).

5 is set in the state counter (S437), and the program returns to the main routine.

If the state counter is 5, the program waits for the detection of the OFF edge of the original feeding detection sensor 351 (YES in S449) and then the timer TA is started (S443), and 6 is set in the state counter (S445). The timer TA defines the time required from the rear edge of the original passed through the original feeding detection sensor 351 to be positioned at a prescribed position.

Thereafter, the program returns to the main routine.

If the state counter is 6, the conveyor belt motor m2 is turned off (S451), provided that the operation of the timer TA is finished (YES in S449). 7 is set in the state counter (S455).

Thereafter, the program returns to the main routine.

If the state counter is 7, and when the next original is set (YES in S461), the copying operation for the original set on the original tray 313 is completed, that is, the exposure and scanning of the original is completed (YES in S463), then 1 is set to the state counter.

Thereafter, the program returns to the main routine.

If the value of the state counter is none of 0 to 7 (NO in S459), the program directly returns to the main routine.

2 in 1 Original Size Detection Routine

Figure 13:
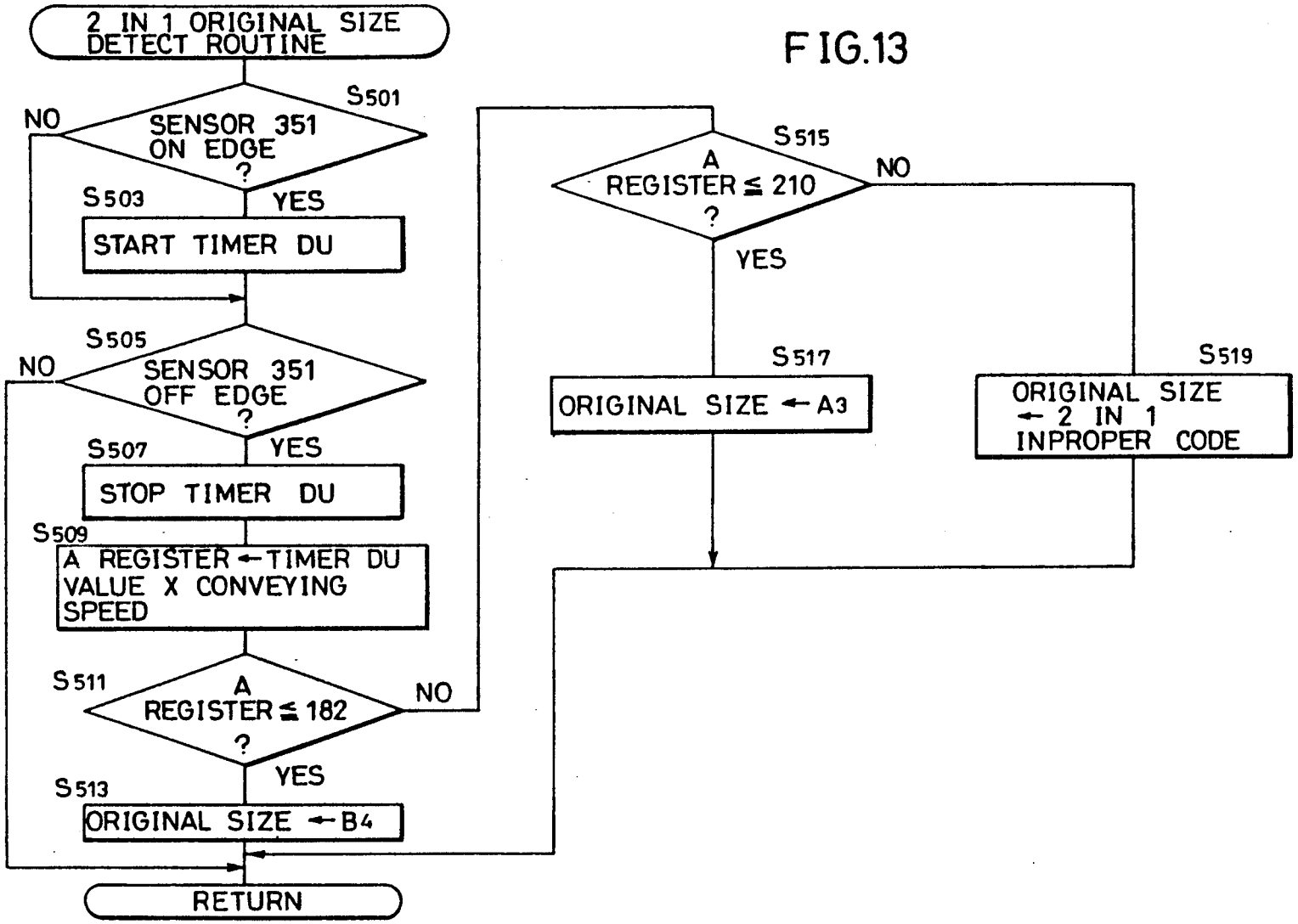
FIG. 13 is a flow chart showing specific contents of the 2 in 1 original size detection routine of FIG. 11A.

FIG. 13 is a flow chart showing specific contents of the 2 in 1 original size detection routine (S63) of FIG. 11A.

When an on edge of the original size detection sensor 351 is detected (YES in S501), a timer DU is started (S503). Thereafter, when the OFF edge of the original size detection sensor 351 is detected (YES in S505), the timer DU is stopped (S507) and a product of the original conveying speed and the original passage time measured by the timer DU (=the length of the original in the feeding direction) is inputted in an A register (S509).

Then, based on the size (the size of the original in the feeding direction) of the original inputted in the A register, the original size in the 2 in 1 mode is determined.

If the value of the A register is not more than 182 mm (the length of the short side of a B5 size sheet) (YES in S511), B4 lengthwise is set at the original size in the 2 in 1 mode (S513).

If the value of the A register exceeds 182 mm and is not more than 210 mm (the length of the short side of A4 size) (YES in S515), A3 lengthwise is set as the original size in the 2 in 1 mode (S517).

If the value of the A register is larger than 210 mm (the length of the short side of A4) (NO in S515), the original is of an improper size for the 2 in 1 mode, therefore a 2 in 1 improper code is set as the original size (S519).

The apparatus of the present invention is controlled as described above, and, as a result, simultaneous setting of the 2 in 1 mode and the manual feeding mode is prohibited, as shown in FIGS. 6 to 9 as examples.

If this improper code is set, the information of setting is transmitted to the body controlling CPU 41 and the 2 in 1 mode display LED 99*b* is flickered, so as to draw attention of the user that the process in the 2 in 1 mode can not be carried out.

Figure 15A:
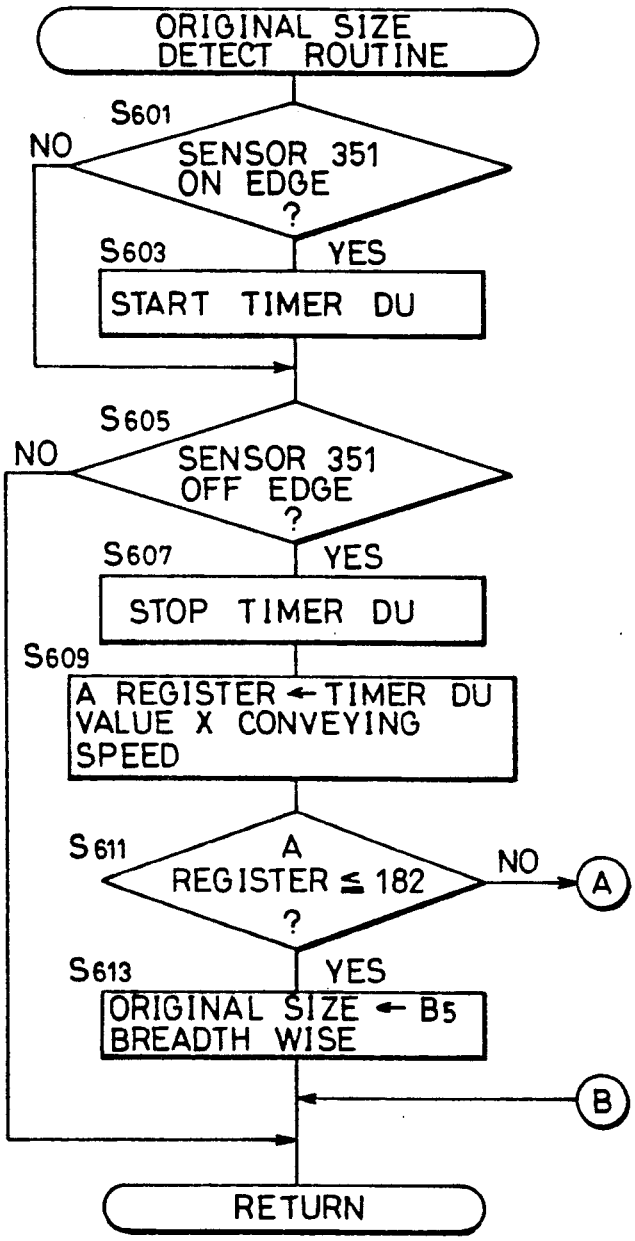
FIGS. 15A and FIG. 15B are flow charts showing specific contents of the original size detection routine of FIG. 11A.
Figure 15B:
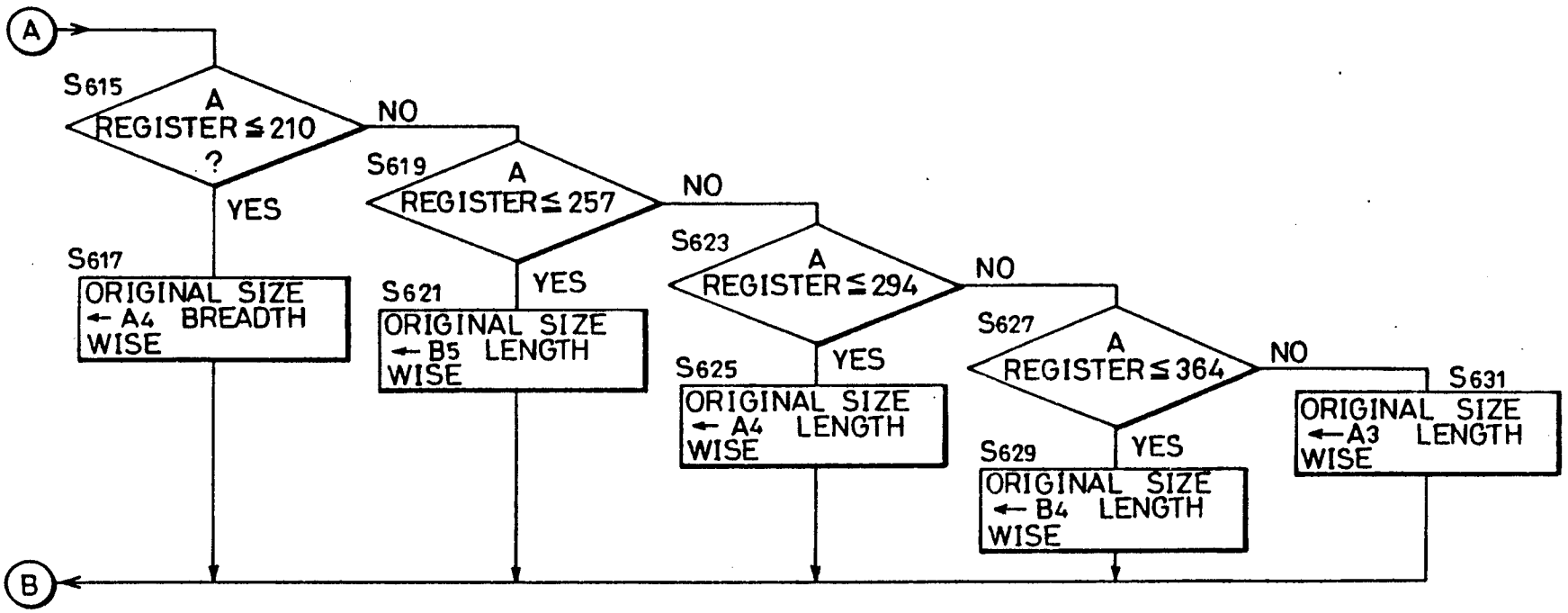

FIGS. 15A and 15B are flow charts showing specific contents of the original size detection routine (S59) of FIG. 11A.

If an ON edge of the original size detection sensor 351 is detected (YES in S601), the timer DU is started (S603).

Thereafter, when an OFF edge of the original size detection sensor 351 is detected (YES in S650), the operation of the timer DU is stopped (S607), and a product of the original conveying speed and the original passage time measured by the timer DU (=the length of the original in the feeding direction) is inputted to the A register (S609).

Then, based on the size of the original (the size of the original in the feeding direction) inputted in the A register, the original size in the normal mode is determined.

If the value of the A register is not more than 182 mm (the length of the short side of B5) (YES in S611), B5 breadthwise is set as the original size in the normal mode (S613).

If the value of the A register exceeds 182 mm and is not more than 210 mm (the length of the short side of A4) (YES in S615), A4 breadthwise is set as the original size in the normal mode (S617).

If the value of the A register exceeds 210 mm and is not more than 257 mm (the length of the long side of B5) (YES in S615), B5 lengthwise is set as the original size in the normal mode (S621).

If the value of the A register exceeds 257 mm and is not more than 294 mm (the length of the long side of A4) (YES in S623), A4 lengthwise is set as the original size in the normal mode (S625).

If the value of the A register exceeds 294 mm and is not more than 364 mm (the length of the long side of B4) (YES in S627), B4 lengthwise is set as the original size in the normal mode (S629).

If the value of the A4 register is larger than 364 mm (the length of the long side of B4) (NO in S627), A3 lengthwise is set as the original size in the normal mode (S631).

Figure 16:
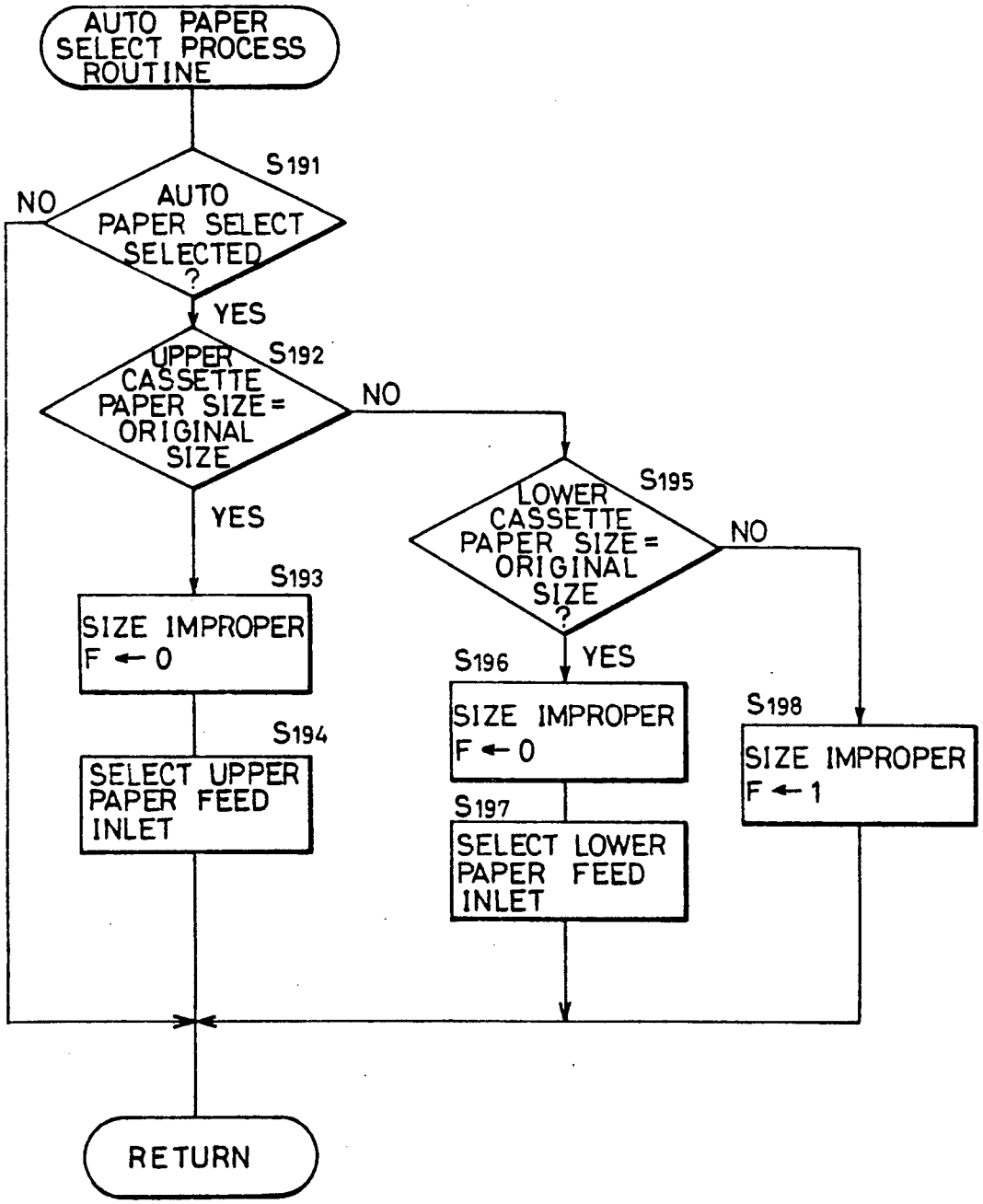
FIG. 16 is a flow chart showing specific contents of an automatic paper selection processing routine of FIG. 5.

FIG. 16 is a flow chart showing specific contents of the automatic paper selection processing routine of FIG. 5.

Referring to the figure, whether or not the automatic paper select process is selected is determined in the step S191. If automatic paper selection is selected, whether or not the paper size of the paper feeding cassette and the original size are the same or not is determined in the step S192. The original size here is the original size detected in the normal mode or in the 2 in 1 mode transmitted from the ADF controlling CPU to the body controlling CPU 41, as shown in FIG. 11A. If these sizes are the same (YES in S192), it means that the size is proper, so that a size improper flag is set to 0 (S193). An upper paper feeding cassette is selected in the step S194.

If the paper size in the upper paper feeding cassette is not the same as the detected original size (NO in S192), whether or not the paper size in the lower paper feeding cassette is the same as the original size is determined in the step S195.

If these sizes are the same, the size improper flag is set to 0 in the step S196, and the lower paper feeding cassette is selected (step S197). If the paper size of the lower paper feeding cassette is not the same as the original size (NO in S195), the size improper flag is set to 1 in the step S198 and the program returns.

In this manner, when the automatic paper selecting process is selected, a cassette containing the sheet of paper corresponding to the original size is automatically selected.

As described above, the present invention provides a copying machine comprising original automatic feeding means, 2 in 1 mode input means, manual feeding means, manual feed mode instructing means, and mode controlling means for inhibiting simultaneous selection of the 2 in 1 mode and the manual feeding mode.

In the present invention, the simultaneous selection of the 2 in 1 mode and the manual feeding mode is inhibited in the following manner, namely, i) when the 2 in 1 mode is instructed under the manual feeding mode, the manual feeding mode is given priority;

ii) when the 2 in 1 mode is instructed under the manual feeding mode, the 2 in 1 mode is given priority;

iii) when the manual feeding mode is instructed under the 2 in 1 mode, the manual feeding mode is given priority; and iv) when the manual feeding mode is instructed under the 2 in 1 mode, the 2 in 1 mode is given priority.

Therefore, the 2 in 1 mode and the manual feeding mode are not set simultaneously. Therefore, generation of miscopies such as missing of images derived from difficult in determining the relation between the original size and the size of the copy paper can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus, comprising:

an original tray on which a plurality of originals can be placed;

conveying mode selecting means for selecting either a first mode or a second mode;

conveying means for taking, in said first mode, one original at a time out of the plurality of original placed on said original tray to set the same at an exposure position, and for taking, in said second mode, two originals continuously out of the plurality of originals placed on said original tray to set the same to the exposure position;

automatic paper feeding means for automatically feeding sheets of copy paper of a prescribed size one by one;

manual paper feeding means for manually feeding a sheet of copy paper of an arbitrary size;

paper feed selecting means for selecting either said automatic paper feeding means or said manual paper feeding means; and controlling means for prohibiting simultaneous selection of said second mode and said manual paper feeding means.

2. A copying apparatus according to claim 1, wherein when said second mode is selected, one sheet of copy paper is fed from said automatic paper feeding means for two originals to be set.

3. A copying apparatus according to claim 1, wherein said automatic paper feeding means comprises a plurality of paper feeding portion, said copying apparatus further comprising paper feeding portion selecting means for selecting one of said plurality of paper feeding portions.

4. A copying apparatus according to claim 3, further comprising:

original size detecting means for detecting the size of an original taken out from said original tray; and automatic paper feeding portion selecting means for selecting, when said automatic paper feeding portion selecting means is selected, a paper feeding portion containing a sheet of copy paper of a proper size based on the result of detection from said original size detecting means, regardless of selection of said paper feeding portion selecting means.

5. A copying apparatus, comprising:

an original tray on which a plurality of originals can be placed;

conveying mode selecting means for selecting either a first mode or in which one original is taken at a time out of the plurality of originals placed on said original tray to be set the same at an exposure position, or a second mode in which two originals are taken continuously out of the plurality of originals placed on the original tray to be set the same at the exposure position;

automatic paper feeding means for automatically feeding sheets of copy paper of a prescribed size one by one;

manual paper feeding means for manually feeding a sheet of copy paper of an arbitrary size;

paper feeding selecting means for selecting either said automatic paper feeding means or said manual paper feeding means; and controlling means for inhibiting selection of said manual paper feeding means, when said second mode is selected.

6. A copying apparatus according to claim 5, wherein one original is fed from said paper feeding means for two originals to be set, when said second mode is selected.

7. A copying apparatus, comprising:

an original tray on which a plurality of originals can be placed;

conveying mode selecting means for selecting a first mode or a second mode;

conveying means for taking, in said first mode, one original at a time out of the plurality of originals placed on said original tray to set the same at an exposure position, and for taking, in said second mode, two originals continuously out of the plurality of originals placed on said original tray, to set the same to the exposure position;

automatic paper feeding means for automatically feeding sheets of copy paper of a prescribed size one by one;

manual paper feeding means for manually feeding a sheet of copy paper of an arbitrary size;

paper feeding selecting means for selecting either said automatic paper feeding means or said manual paper feeding means; and controlling means for inhibiting selection of said second mode, when said manual paper feeding means is selected.

8. A copying apparatus according to claim 7, wherein one sheet of copy paper is fed from said paper feeding means for two originals to be set, when said second mode is selected.

9. In a copying apparatus comprising conveying means operable in a first mode in which originals set in an original tray is fed one by one and in a second mode in which original set in the original tray are fed two by two, automatic paper feeding, and a paper feeding portion capable of manually feeding paper, a processing step comprising the steps of:

selecting the manual paper feeding portion; and selecting the first mode in response to the selection of the manual paper feeding portion.

10. A copying apparatus comprising:

an original tray on which a plurality of originals can be placed;

conveying means for taking two originals continuously out of the plurality of originals placed on said original tray to an exposure position when a particular mode is set, and for taking one original at a time out of the plurality of originals placed on said original tray to the exposure position when the particular mode is not set;

automatic paper feeding means for automatically feeding sheets of copy paper of a prescribed size one by one;

manual paper feeding means for manually feeding a sheet of copy paper of an arbitrary size; and controlling means for controlling switching from said manual paper feeding means to said automatic paper feeding means in response to a setting of said particular mode during an operation of said manual paper feeding means.

11. A copying apparatus according to claim 10, wherein one sheet of copy paper is fed from said paper feeding means for two set originals, when said particular mode is set.

12. A copying apparatus according to claim 10, further comprising paper feed selecting means for selecting either said automatic paper feeding means or said manual paper feeding means, wherein said controlling means selects said automatic paper feeding means regardless of the selection of said paper feeding selection means.

13. A copying apparatus comprising:

an original tray on which a plurality of originals can be placed;

conveying means for taking two originals continuously out of the plurality of originals placed on said original tray to set at the exposure position when a particular mode is set, and for taking one original at a time out of the plurality of originals placed on said original tray to set at the exposure position when the particular mode is not set;

automatic paper feeding means for automatically feeding sheets of copy paper of the prescribed size one by one;

manual paper feeding means for manually feeding a sheet of copy paper of an arbitrary size;

paper feeding selecting means for selecting either said automatic paper feeding means or said manual paper feeding means; and controlling means for controlling said conveying means to take one original at a time to set at the exposure position in response to a selection of said manual paper feeding means during an operation of said particular mode.

14. A copying apparatus according to claim 13, wherein one sheet of copy paper is fed from said paper feeding means for two set originals to be set, when said particular mode is set.

15. A copying apparatus according to claim 13, wherein said controlling means controls said conveying means to take one original at a time to set at the exposure position in response to the selection of said manual paper feeding means, regardless of the setting of said particular mode.

16. A copying apparatus, comprising: an original tray on which a plurality of originals can be placed;

conveying mode selecting means for selecting either a first mode or a second mode;

conveying means for taking, in said first mode, one original at a time out of the plurality of original placed on said original tray to set the same at an exposure position, and for taking, in said second mode, two originals continuously out of the plurality of originals placed on said original tray to set the same to at the exposure position;

automatic paper feeding means for automatically feeding sheets of copy paper of a prescribed size one by one, said automatic paper feeding means comprises a plurality of paper feeding portions;

manual paper feeding means for manually feeding a sheet of copy paper of an arbitrary size;

paper feed selecting means for selecting either said automatic paper feeding means or said manual paper feeding means;

controlling means for prohibiting simultaneous selection of said second mode and said manual paper feeding means;

original size detecting means for detecting size of the original taken out from said original tray; and automatic paper feeding portion selecting means for selecting, when said automatic paper feeding means is selected, a paper feeding portion containing a sheet of copy paper corresponding to the original size, based on the result of detection of said original size detecting means.

17. A copying apparatus according to claim 16, wherein when said second mode is selected, one sheet of copy paper is fed from said automatic paper feeding means for two originals to be set.

18. A copying apparatus according to claim 16, wherein said automatic paper feeding portion selecting means selects, when said second mode is selected, a paper feeding portion containing a sheet of copy paper of a size twice as large as the result of detection of said original size detecting means.

19. A copying apparatus comprising:

an original tray on which a plurality of originals can be placed;

conveying means for taking two originals continuously out of the plurality of originals placed on said original tray to an exposure position when a particular mode is set, and for taking one original at a time out of the plurality of originals placed on said original tray to the exposure position when the particular mode is not set;

automatic paper feeding means for automatically feeding sheets of copy paper of a prescribed size one by one, said automatic paper feeding means comprises a plurality of paper feeding portions;

manual paper feeding means for manually feeding a sheet of copy paper of an arbitrary size; controlling means for controlling switching from said manual paper feeding means to said automatic paper feeding means in response to a setting of said particular mode during an operation of said manual paper feeding means;

original size detecting means for detecting the size of an original taken out from said original tray; and automatic paper feeding portion selecting means for selecting, when said automatic paper feeding means is selected, a paper feeding portion containing a sheet of copy paper corresponding to the original size, based on the result of detection from said original size detecting means.

20. A copying apparatus according to claim 19, wherein said automatic paper feeding selecting means selects, when said particular mode is set, a paper feeding portion containing a sheet of copy paper of a size twice as large as the result of the detection of said original size detecting means.

21. A copying apparatus according to claim 19, wherein one sheet of copy paper is fed from said paper feeding means for two set originals, when said particular mode is selected.

22. A copying apparatus according to claim 19, wherein said automatic paper feeding portion selecting means selects, when said particular mode is set, a paper feeding portion containing a sheet of copy paper of a size twice as large as the result of detection of said original size detecting means.

23. A copying apparatus according to claim 19, further comprising paper feed selecting means for selecting either said automatic paper feeding means or said manual paper feeding means, wherein said controlling means selects said automatic paper feeding means regardless of the selection of said paper feeding selection means.

24. A copying apparatus according to claim 19, further comprising paper feeding portion selecting means for selecting one of said plurality of paper feeding portions, wherein said automatic paper feeding portion selecting means selects a paper feeding portion containing a sheet of copy paper of an optimal size based on the result of detection of said original size detecting means, regardless of the selection of said paper feeding portion selecting means.

25. A copying apparatus comprising:

an original tray on which a plurality of originals can be placed;

conveying means for taking two originals continuously out of the plurality of originals placed on said original tray to set at the exposure position when a particular mode is set, and for taking one original at a time out of the plurality of originals placed on said original tray to set at the exposure position when the particular mode is not set;

automatic paper feeding means for automatically feeding sheets of copy paper of the prescribed size one by one, said automatic paper feeding means comprises a plurality of paper feeding portions;

manual paper feeding means for manually feeding a sheet of copy paper of an arbitrary size;

paper feeding selecting means for selecting either said automatic paper feeding means or said manual paper feeding means;

controlling means for controlling said conveying means to take one original at a time to set at the exposure position in response to a selection of said manual paper feeding means during an operation of said particular mode;

original size detecting means for detecting the size of an original taken out from said original tray; and automatic paper feeding portion selecting means for selecting a paper feeding portion containing a sheet of copy paper of an optimal size based on the result of detection of said original size detection means, when said automatic paper feeding means is selected.

26. A copying apparatus according to claim 25, wherein one sheet of copy paper is fed from said paper feeding means for two originals to be set, when said particular mode is set.

27. A copying apparatus according to claim 25, wherein said automatic paper feeding portion selecting means selects a paper feeding portion containing a sheet of copy paper of a size twice as large as the result of detection of said original size detecting means, when said particular mode is set.

28. A copying apparatus according to claim 25, further comprising said controlling means controls said conveying means to take one original at a time to set at the response status in response to the selection of said manual paper feeding means, regardless of the setting of said particular mode.

29. A copying apparatus, comprising:

an original tray on which a plurality of originals can be placed;

conveying mode selecting means for selecting either a first mode or in which one original is taken at a time out of the plurality of originals placed on said original tray to be set the same at an exposure position, or a second mode in which two originals are taken continuously out of the plurality of originals placed on the original tray to be set the same at the exposure position;

automatic paper feeding means for automatically feeding sheets of copy paper of a prescribed size one by one, said automatic paper feeding means comprises a plurality of paper feeding portions;

manual paper feeding means for manually feeding a sheet of copy paper of an arbitrary size;

paper feeding selecting means for selecting either said automatic paper feeding means or said manual paper feeding means;

controlling means for inhibiting selection of said manual paper feeding means, when said second mode is selected;

original size detecting means for detecting the size of an original taken out from said original tray; and automatic paper feeding portion selecting means for selecting a paper feeding portion containing a sheet of copy paper of an optimal size based on the result of detection from said original size detecting means, when said automatic paper feeding means is selected.

30. A copying apparatus according to claim 29, wherein one original is fed from said paper feeding means for two originals to be set, when said second mode is selected.

31. A copying apparatus according to claim 29, wherein said automatic paper feeding portion selecting means selects a paper feeding portion containing a sheet of copy paper of a size twice as large as the result of detection from said original size detecting means, when said second mode is selected.

32. A copying apparatus according to claim 29, further comprising paper feeding portion selecting means for selecting one of the plurality of paper feeding portions of said automatic paper feeding means, wherein said automatic paper feeding portion selecting means selecting a paper feeding portion containing a sheet of copy paper of an optimal size based on the result of detection of said original size detecting means, regardless of the selection of said paper feeding portion selecting means.

33. A copying apparatus, comprising:

an original tray on which a plurality of originals can be placed;

conveying mode selecting means for selecting a first mode or a second mode;

conveying means for taking, in said first mode, one original at a time out of the plurality of originals placed on said original tray to set the same at an exposure position, and for taking, in said second mode, two originals continuously out of the plurality of originals placed on said original tray, to set the same to the exposure position;

automatic paper feeding means for automatically feeding sheets of copy paper of a prescribed size one by one, said automatic paper feeding means comprises a plurality of paper feeding portions;

manual paper feeding means for manually feeding a sheet of copy paper of an arbitrary size;

paper feeding selecting means for selecting either said automatic paper feeding means or said manual paper feeding means;

controlling means for inhibiting selection of said second mode, when said manual paper feeding means is selected;

original size detecting means for detecting the size of an original taken out from said original tray; and automatic paper feeding portion selecting means for selecting a paper feeding portion containing a sheet of copy paper of an optimal size, based on the result of detection from said original size detecting means, when said automatic paper feeding means is selected.

34. A copying apparatus according to claim 33, wherein one sheet of copy paper is fed from said paper feeding means for two originals to be set, when said second mode is selected.

35. A copying apparatus according to claim 33, wherein said automatic paper feeding portion selecting means selects a paper feeding portion containing a sheet of copy paper of a size twice as large as the result of detection from said original size detecting means, when said second mode is selected.

36. A copying apparatus according to claim 33, further comprising paper feeding portion selecting means for selecting a paper feeding portion out of the plurality of paper feeding portions of said automatic paper feeding means, wherein said automatic paper feeding portion selecting means selects a paper feeding portion containing a sheet of copy paper of an optimal size based on the result of detection from said original size detecting means, regardless of the selection of said paper feeding portion selecting means, when said automatic paper feeding means is selected.

* * * * *